US009520104B2

(12) United States Patent
Nakamura

(10) Patent No.: US 9,520,104 B2
(45) Date of Patent: Dec. 13, 2016

(54) IMAGE DISPLAY DEVICE AND LUT ADJUSTMENT METHOD

(71) Applicant: Funai Electric Co., Ltd., Daito-shi, Osaka (JP)

(72) Inventor: Yuya Nakamura, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 256 days.

(21) Appl. No.: 13/892,469

(22) Filed: May 13, 2013

(65) Prior Publication Data

US 2013/0314436 A1 Nov. 28, 2013

(30) Foreign Application Priority Data

May 22, 2012 (JP) ..... 2012-116970

(51) Int. Cl.
*G09G 5/06* (2006.01)
*G09G 3/36* (2006.01)

(52) U.S. Cl.
CPC ..... *G09G 5/06* (2013.01); *G09G 3/3611* (2013.01); *G09G 2320/0285* (2013.01); *G09G 2320/066* (2013.01); *G09G 2320/0673* (2013.01); *G09G 2360/145* (2013.01)

(58) Field of Classification Search
None
See application file for complete search history.

(56) References Cited

U.S. PATENT DOCUMENTS

2001/0015774 A1 8/2001 Endo et al.
2004/0196303 A1* 10/2004 Matsuda ..... 345/690
2005/0017989 A1* 1/2005 Huang ..... 345/690
2006/0238480 A1 10/2006 Furihata et al.
(Continued)

FOREIGN PATENT DOCUMENTS

JP 2004-180090 A 6/2004
JP 3697997 B2 9/2005
(Continued)

OTHER PUBLICATIONS

Official Communication issued in corresponding European Patent Application No. 13168038.1, mailed on Jul. 29, 2013.

*Primary Examiner* — Ming Hon
*Assistant Examiner* — Yu-Jang Tswei
(74) *Attorney, Agent, or Firm* — Keating & Bennett, LLP

(57) ABSTRACT

An image display device includes a microcomputer and LUTs which are tables of correction data used to correct color balance of images. The microcomputer sets LUT extensions and calculates the LUTs based on: (1) the normalized values $GainL_n$ of the L conforming adjustment values GainL and the normalized values $GainH_n$ of the H conforming adjustment values GainH; (2) the normalized values $Li_n$ of the input values $Li_{ref}$ of the image data of the L adjustment image and the normalized values $Hi_n$ of the input values $Hi_{ref}$ of the image data of the H adjustment image; (3) the correction data of the LUTs; and (4) the correction data of the LUT extension units.

20 Claims, 10 Drawing Sheets

(56) References Cited

U.S. PATENT DOCUMENTS

| | | | | |
|---|---|---|---|---|
| 2008/0297451 | A1* | 12/2008 | Marcu | 345/77 |
| 2012/0188265 | A1 | 7/2012 | Suzuki | |
| 2012/0206478 | A1 | 8/2012 | Nakamura et al. | |
| 2012/0206654 | A1 | 8/2012 | Nakamura et al. | |

FOREIGN PATENT DOCUMENTS

| | | | |
|---|---|---|---|
| JP | 4536582 | B2 | 9/2010 |
| JP | 2012-39463 | A | 2/2012 |

* cited by examiner

IMAGE DISPLAY DEVICE AND LUT ADJUSTMENT METHOD

BACKGROUND OF THE INVENTION

1. Field of the Invention

The present invention relates to an image display device which displays images on a display and a LUT adjustment method for adjusting LUT correction data provided for an image display device.

2. Description of the Related Art

In image display devices such as television receivers, for example, there have conventionally been those in which liquid crystal panels are used as displays, and images are displayed on the liquid crystal panels. Such an image display device is provided with LUTs, which are tables of correction data for correcting the chromaticity of the displayed images, and is designed such that the images are displayed on the liquid crystal panel after correcting the chromaticity based on the LUT correction data. A LUT is a table of correction data for correcting the input values of image data, which indicates the relationship between LUT input values which are the uncorrected values and LUT output values which are the corrected values of the LUT input values. To wit, in such an image display device, the input values of image data are corrected based on the LUT correction data, and images are displayed on the liquid crystal panel based on the corrected input values.

Furthermore, in such an image display device, chromaticity characteristics of displayed images are adjusted to the desired chromaticity characteristics of various types such as the normal type, cool type, and warm type by providing a gain adjusting unit that applies a gain to the input values of image data and adjusting the gain value of the gain adjusting unit (the value of the gain to be applied to the input values of image data).

The LUT correction data is calculated and created using one standard panel as the liquid crystal panel based on the chromaticity of the images displayed on the standard panel. Moreover, the gain values of the gain adjusting unit are also determined using a standard panel based on the chromaticity of the images displayed on the standard panel.

Image display devices have been known (for example, see Japanese Patent Publication No. 3697997) in which the contrast is measured, a dynamic range that can be utilized for display is set, and gain adjustment and offset adjustment are performed to match the dynamic range, and thereafter, the data of the lookup table is recalculated such that the dynamic range becomes the full range, and the recalculated data is written. In addition, display control devices have been known (for example, see Japanese Patent Publication No. 4536582) in which the grayscale values of output image data are used as arguments, logical values indicating whether to use or not are used as array elements in a lookup table of grayscale values represented by the arguments, and the lookup table is generated based on the sum of the arguments and the array elements. Furthermore, video signal processing devices have been known (for example, see Japanese Patent Application Laid-Open Publication No. 2004-180090) in which three primary-color input video signals are subjected to level adjustment at the same gain as each other in accordance with a first gain data set, three primary-color internal video signals are generated, a second gain data set is generated in accordance with the maximum value selected for each pixel unit from the three primary-color internal video signals by using a lookup table that has nonlinear characteristics written thereto with the maximum value selected for each pixel unit from the three primary-color internal video signals as an address, and the lookup table is rewritten in accordance with the input nonlinear characteristic data.

Incidentally, within image display devices, there are differences among individual liquid crystal panels. For the reason, even if one should adopt in an image display device the same LUT prepared based on a standard panel and set the same gain value as the one determined based on the standard panel, the chromaticity characteristics of the images displayed on the liquid crystal panel of the image display device would have characteristics different from the standard chromaticity characteristics (the chromaticity characteristics designed with the standard panel).

Accordingly, in an image display device, in order to set the chromaticity characteristics of a displayed image to the standard chromaticity characteristics, it is necessary to perform white balance and γ adjustments which adjust the chromaticity characteristics of a displayed image. The white balance and γ adjustments could conceivably be done by calculating the LUT correction data (again, calculated anew) and rewriting the data.

However, in cases where the chromaticity characteristics are adjusted by adjusting the gain value of the gain adjusting unit (adjusted to the desired chromaticity characteristics of various types such as the normal type, cool type, and warm type), there is a risk that the expected white balance and γ adjustments cannot be realized because of the gain value being adjusted. That is, there is a risk that white balance and γ adjustments that are appropriate to match the various chromaticity characteristics cannot be realized. Moreover, if the LUT correction data were to be calculated simply to reach the standard chromaticity characteristics, then there is a risk that the maximum brightness of the display would be limited by the maximum output value of the LUT. As a result, there is a risk that one may not be able to take effective advantage of the maximum brightness potential of the display, so the brightness may drop, and there is a risk that appropriate chromaticity corrections cannot be done with respect to high-grayscale images. Note that the aforementioned problems cannot be solved even with the application of the contents disclosed in the aforementioned Japanese Patent Publication No. 3697997, Japanese Patent Publication No. 4536582 and Japanese Patent Application Laid-Open Publication No. 2004-180090.

SUMMARY OF THE INVENTION

In view of the problems described above, preferred embodiments of the present invention provide an image display device and a LUT adjustment method which can realize appropriate white balance and γ adjustments to match various chromaticity characteristics.

In addition, preferred embodiments of the present invention provide an image display device and a LUT adjustment method which can realize white balance and γ adjustments that make appropriate chromaticity corrections possible with respect to high-grayscale images while taking effective advantage of the maximum brightness potential of the display.

According to a preferred embodiment of the present invention, an image display device includes an input value adjustment unit that applies a gain or offset to input values of image data; a LUT which is a table of correction data used to correct the input values of image data having a gain or offset applied thereto by the input value adjustment unit and which is a table indicating the relationship between the LUT input values that are the uncorrected values and LUT output values that are the corrected values of the LUT input values; a display which displays images based on the input values of the image data that have been corrected on the basis of the LUT correction data; a conforming adjustment value acquisition unit that acquires conforming adjustment values, where the conforming adjustment values are defined as being adjustment values which are the values of the gain or offset applied to the input values of image data of an adjustment image by the input value adjustment unit when the color balance of the adjustment image displayed on the display becomes a specified color balance; a LUT extension unit setting unit that sets a LUT extension unit which is a table indicating the relationship between extension unit input values which are values greater than the maximum value that a LUT input value of the LUT can take and extension unit output values which are the corrected values of the extension unit input values; and a LUT calculation unit that calculates the LUT correction data based on the conforming adjustment values acquired by the conforming adjustment value acquisition unit, the input values of the image data of the adjustment image, the LUT correction data, and the correction data of the LUT extension unit that has been set by the LUT extension unit setting unit.

In the image display device according to a preferred embodiment of the present invention, furthermore, with regard to the LUT extension unit, if the LUT output value corresponding to the maximum value that the LUT input value of the LUT can take does not reach the maximum value that the LUT output value of the LUT can take, and also the conforming adjustment value acquired by the conforming adjustment value acquisition unit is greater than the reference adjustment value which is the initial value of the adjustment value applied by the input value adjustment unit to the input values of the image data of the adjustment image, then it is desirable that the LUT extension unit be set, and that taking the LUT input values of the LUT and the extension unit input values of the LUT extension unit to be x, the LUT output values before the calculation of the LUT to be y=F(x), the extension unit output values of the LUT extension unit to be H(x), and the LUT output values after the calculation of the LUT to be y=G(x), the LUT calculation unit calculate the LUT output values after the calculation of the LUT y=G(x) as follows:

(1) over the range $x \le Li_{ref}$:

$$y=G(x)=F(\mathrm{Gain}L\times x)$$

(2) over the range $Li_{ref}<x\le Hi_{ref}$:

$$y=G(x)=F((a\times \mathrm{Gain}H+(1-\alpha)\times \mathrm{Gain}L)\times x)$$

(3) over the range $Hi_{ref}<x$:

(A) in the case of GainH≤1:

$$y=G(x)=F(\mathrm{Gain}H\times x)$$

(B) in the case of 1<GainH:

(B-1) if F(MAXi)=MAXo, then:

(if the LUT extension unit is not set, then:)

$$y=G(x)=F(a1\times x+b1)$$

(B-2) if F(MAXi)<MAXo, then:

(if the LUT extension unit is set, then:)

(i) when GainH≤Q/MAXi:

(i-1) over the range of x where 0≤GainH×x≤MAXi:

$$y=G(x)=F(\mathrm{Gain}H\times x)$$

(i-2) over the range of x where MAXi<GainH×x≤Q:

$$y=G(x)=H(\mathrm{Gain}H\times x)$$

(ii) when Q/MAXi<GainH:

(ii-1) over the range of x where 0<c×x+d≤MAXi:

$$y=G(x)=F(c\times x+d)$$

(ii-2) over the range of x where MAXi<c×x+d≤Q:

$$y=G(x)=H(c\times x+d)$$

(where $Li_{ref}$: input value of image data of a first adjustment image $Hi_{ref}$: input value of image data of a second adjustment image $(Li_{ref}<Hi_{ref})$ GainL: value of the gain applied to $Li_{ref}$ when the color balance of the first adjustment image becomes a specified color balance (conforming adjustment value)

GainH: value of the gain applied to $Hi_{ref}$ when the color balance of the second adjustment image becomes a specified color balance (conforming adjustment value)

$\alpha=(x-Li_{ref})/(Hi_{ref}-Li_{ref})$: interpolation coefficient $$a1=(\mathrm{MAX}o-Ho_{ref})/(\mathrm{MAX}i-Hi_{ref})$$

$$b1=Ho_{ref}-Hi_{ref}\times(\mathrm{MAX}o-Ho_{ref})/(\mathrm{MAX}i-Hi_{ref})$$

$$C=(Q-Ho_{ref})/(\mathrm{MAX}i-Hi_{ref})$$

$$d=Ho_{ref}-Hi_{ref}\times(Q-Ho_{ref})/(\mathrm{MAX}i-Hi_{ref})$$

$$Ho_{ref}=Hi_{ref}\times \mathrm{Gain}H$$

MAXi: maximum value that the LUT input value x can take in F(x) and G(x)

MAXo: maximum value that F(x) and G(x) can take

Q: maximum value that the extension unit input value x can take in H(x))

According to another preferred embodiment of the present invention, a LUT adjustment method includes an adjustment image display step in which an adjustment image is displayed on a color display after applying a gain or offset to input values of image data of the adjustment image and, based on LUT correction data, correcting the input values of image data of the adjustment image to which the gain or offset has been applied; an adjustment value adjusting step in which the adjustment values that are the values of the gain or offset applied to the input values of the image data of the adjustment image are adjusted such that the color balance of the adjustment image displayed in the adjustment image display step becomes a specified color balance; a conforming adjustment value determination step in which the adjustment values that have been adjusted in the adjustment value adjusting step and that are the values of the gain or offset applied to the input values of the image data of the adjustment image when the color balance of the adjustment image becomes a specified color balance are determined as the conforming adjustment values; a LUT extension unit setting step in which a LUT extension unit is set, with the LUT extension unit being a table indicating the relationship between extension unit input values which are values greater than the maximum value that a LUT input value of the LUT can take and extension unit output values which are the corrected values of the extension unit input values; and a LUT calculation step in which the LUT correction data is calculated based on the conforming adjustment values determined in the conforming adjustment value determination step, the input values of the image data of the adjustment image, the LUT correction data, and the correction data of the LUT extension unit that has been set in the LUT extension unit setting step.

In addition, in the LUT adjustment method according to a preferred embodiment of the present invention, if the LUT output value corresponding to the maximum value that the LUT input value of the LUT can take does not reach the maximum value that the LUT output value of the LUT can take, and also the conforming adjustment value determined in the conforming adjustment value determination step is greater than the reference adjustment value which is the initial value of the adjustment value applied to the input values of the image data of the adjustment image, then it is desirable that the LUT extension unit be set in the LUT extension unit setting step, and that taking the LUT input values of the LUT and the extension unit input values of the LUT extension unit to be x, the LUT output values before the calculation of the LUT to be y=F(x), the extension unit output values of the LUT extension unit to be H(x), and the LUT output values after the calculation of the LUT to be y=G(x), the LUT output values after the calculation of the LUT y=G(x) be calculated as follows in the LUT calculation step:

(1) over the range $x \leq Li_{ref}$:

$$y=G(x)=F(\mathrm{Gain}L\times x)$$

(2) over the range $Li_{ref}<x\leq Hi_{ref}$:

$$y=G(x)=F((\alpha\times\mathrm{Gain}H+(1-\alpha)\times\mathrm{Gain}L)\times x)$$

(3) over the range $Hi_{ref}<x_R$:

(A) in the case of GainH≤1:

$$y=G(x)=F(\mathrm{Gain}H\times x)$$

(B) in the case of 1<GainH:

(B-1) if F(MAXi)=MAXo, then:

(if the LUT extension unit is not set, then:)

$$y=G(x)=F(a1\times x+b1)$$

(B-2) if F(MAXi)<MAXo, then:

(if the LUT extension unit is set, then:)

(i) when GainH≤Q/MAXi:

(i-1) over the range of x where 0≤GainH×x≤MAXi:

$$y=G(x)=F(\mathrm{Gain}H\times x)$$

(i-2) over the range of x where MAXi<GainH×x≤Q:

$$y=G(x)=H(\mathrm{Gain}H\times x)$$

(ii) when Q/MAXi<GainH:

(ii-1) over the range of x where 0<c×x+d≤MAXi:

$$y=G(x)=F(c\times x+d)$$

(ii-2) over the range of x where MAXi<c×x+d≤Q:

$$y=G(x)=H(c\times x+d)$$

(where $Li_{ref}$: input value of image data of a first adjustment image $Hi_{ref}$: input value of image data of a second adjustment image $$(Li_{ref}<Hi_{ref})$$

GainL: value of the gain applied to $Li_{ref}$ when the color balance of the first adjustment image becomes a specified color balance (conforming adjustment value)

GainH: value of the gain applied to $Hi_{ref}$ when the color balance of the second adjustment image becomes a specified color balance (conforming adjustment value)

$\alpha=(x-Li_{ref})/(Hi_{ref}-Li_{ref})$: interpolation coefficient $$a1=(\mathrm{MAX}o-Ho_{ref})/(\mathrm{MAX}i-Hi_{ref})$$

$$b1=Ho_{ref}-Hi_{ref}\times(\mathrm{MAX}o-Ho_{ref})/(\mathrm{MAX}i-Hi_{ref})$$

$$C=(Q-Ho_{ref})/(\mathrm{MAX}i-Hi_{ref})$$

$$d=Ho_{ref}-Hi_{ref}\times(Q-Ho_{ref})/(\mathrm{MAX}i-Hi_{ref})$$

$$Ho_{ref}=Hi_{ref}\times\mathrm{Gain}H$$

MAXi: maximum value that the LUT input value x can take in F(x) and G(x)

MAXo: maximum value that F(x) and G(x) can take

Q: maximum value that the extension unit input value x can take in H(x))

According to yet another preferred embodiment of the present invention, an image display device includes an input value adjustment unit that applies a gain or offset to input values of image data; a LUT which is a table of correction data used to correct the input values of image data having a gain or offset applied thereto by the input value adjustment unit and which is a table indicating the relationship between the LUT input values that are the uncorrected values and LUT output values that are the corrected values of the LUT input values; a display which displays images based on the input values of the image data that have been corrected on the basis of the LUT correction data; a conforming adjustment value acquisition unit that acquires conforming adjustment values, where the conforming adjustment values are defined as being adjustment values which are the values of the gain or offset applied to the input values of image data of an adjustment image by the input value adjustment unit when the color balance of the adjustment image displayed on the display becomes a specified color balance; a conforming adjustment value normalization unit that normalizes the conforming adjustment values acquired by the conforming adjustment value acquisition unit; an adjustment-use input value normalization unit that normalizes the input values of the image data of the adjustment image; a LUT extension unit setting unit that sets a LUT extension unit which is a table indicating the relationship between extension unit input values which are values greater than the maximum value that a LUT input value of the LUT can take and extension unit output values which are the corrected values of the extension unit input values; and a LUT calculation unit that calculates the LUT correction data based on the conforming adjustment values normalized by the conforming adjustment value normalization unit, the input values of the image data of the adjustment image normalized by the adjustment-use input value normalization unit, the LUT correction data, and the correction data of the LUT extension unit that has been set by the LUT extension unit setting unit. The normalization of conforming adjustment values is defined as dividing the conforming adjustment values by the reference adjustment value (the initial value of the adjustment value applied to input values of the image data of the adjustment image), and normalized conforming adjustment values are defined as being the values obtained by dividing the conforming adjustment values by the reference adjustment value. The normalization of input values of image data of the adjustment image is defined as multiplying input values of the image data of the adjustment image by the reference adjustment value, and normalized input values of the image data of the adjustment image are defined as being the values obtained by multiplying the input values of the image data of the adjustment image by the reference adjustment value.

Moreover, in the image display device according to a preferred embodiment of the present invention, with regard to the LUT extension unit, if the LUT output value corresponding to the maximum value that the LUT input value of the LUT can take does not reach the maximum value that the LUT output value of the LUT can take, and also the conforming adjustment value acquired by the conforming adjustment value acquisition unit is greater than the reference adjustment value which is the initial value of the adjustment value applied by the input value adjustment unit to the input values of the image data of the adjustment image, then it is desirable that the LUT extension unit be set, and that taking the LUT input values of the LUT and the extension unit input values of the LUT extension unit to be x, the LUT output values before the calculation of the LUT to be y=F(x), the extension unit output values of the LUT extension unit to be H(x), and the LUT output values after the calculation of the LUT to be y=G(x), the LUT calculation unit calculate the LUT output values after the calculation of the LUT y=G(x) as follows:

(1) over the range $x \le Li_n$:

$$y=G(x)=F(\mathrm{Gain}L_n \times x)$$

(2) over the range $Li_n < x \le Hi_n$:

$$y=G(x)=F((\alpha_n \times \mathrm{Gain}H_n+(1-\alpha_n)\times \mathrm{Gain}L_n)\times x)$$

(3) over the range $Hi_n < x$:

(A) in the case of $\mathrm{Gain}H_n \le 1$:

$$y=G(x)=F(\mathrm{Gain}H_n \times x)$$

(B) in the case of $1 < \mathrm{Gain}H_n$:

(B-1) if F(MAXi)=MAXo, then:

(if the LUT extension unit is not set, then:)

$$y=G(x)=F(a1_n \times x+b1_n)$$

(B-2) if F(MAXi)<MAXo, then:

(if the LUT extension unit is set, then:)

(i) when $\mathrm{Gain}H_n \le Q/\mathrm{MAX}i$:

(i-1) over the range of x where $0 \le \mathrm{Gain}H_n \times x \le \mathrm{MAX}i$:

$$y=G(x)=F(\mathrm{Gain}H_n \times x)$$

(i-2) over the range of x where $\mathrm{MAX}i < \mathrm{Gain}H_n \times x \le Q$:

$$y=G(x)=H(\mathrm{Gain}H_n \times x)$$

(ii) when $Q/\mathrm{MAX}i < \mathrm{Gain}H_n$:

(ii-1) over the range of x where $0 < c_n \times x+d_n \le \mathrm{MAX}i$:

$$y=G(x)=F(c_n \times x+d_n)$$

(ii-2) over the range of x where $\mathrm{MAX}i < c_n \times x+d_n \le Q$:

$$y=G(x)=H(c_n \times x+d_n)$$

(where $\mathrm{Gain}_{ref}$: initial value of the gain (adjustment value) applied to input values of the image data (the reference adjustment value)

$Li_{ref}$: input value of image data of a first adjustment image $Hi_{ref}$: input value of image data of a second adjustment image $$(Li_{ref} < Hi_{ref})$$

GainL: value of the gain applied to $Li_{ref}$ when the color balance of the first adjustment image becomes a specified color balance (conforming adjustment value)

GainH: value of the gain applied to $Hi_{ref}$ when the color balance of the second adjustment image becomes a specified color balance (conforming adjustment value)

$\mathrm{Gain}L_n=\mathrm{Gain}L/\mathrm{Gain}_{ref}$: normalized value of GainL $\mathrm{Gain}H_n=\mathrm{Gain}H/\mathrm{Gain}_{ref}$: normalized value of GainH $Li_n=Li_{ref} \times \mathrm{Gain}_{ref}$: normalized value of $Li_{ref}$ $Hi_n=Hi_{ref} \times \mathrm{Gain}_{ref}$: normalized value of $Hi_{ref}$ $\alpha_n=(x-Li_n)/(Hi_n-Li_n)$: interpolation coefficient $a1_n=(\mathrm{MAX}o-Ho_n)/(\mathrm{MAX}i-Hi_n)$ $b1_n=Ho_n-Hi_n \times (\mathrm{MAX}o-Ho_n)/(\mathrm{MAX}i-Hi_n)$ $c_n=(Q-Ho_n)/(\mathrm{MAX}i-Hi_n)$ $d_n=Ho_n-Hi_n \times (Q-Ho_n)/(\mathrm{MAX}i-Hi_n)$ $Ho_n=Hi_n \times \mathrm{Gain}H_n$ MAXi: maximum value that the LUT input value x can take in F(x) and G(x)

MAXo: maximum value that F(x) and G(x) can take

Q: maximum value that the extension unit input value x can take in H(x))

In addition, a LUT adjustment method according to a preferred embodiment of the present invention includes an adjustment image display step in which an adjustment image is displayed on a color display after applying a gain or offset to input values of image data of the adjustment image and, based on LUT correction data, correcting the input values of image data of the adjustment image to which the gain or offset has been applied; an adjustment value adjusting step in which the adjustment values that are the values of the gain or offset applied to the input values of the image data of the adjustment image are adjusted such that the color balance of the adjustment image displayed in the adjustment image display step becomes a specified color balance; a conforming adjustment value determination step in which the adjustment values that have been adjusted in the adjustment value adjusting step and that are the values of the gain or offset applied to the input values of the image data of the adjustment image when the color balance of the adjustment image becomes a specified color balance are determined as the conforming adjustment values; a conforming adjustment value normalization step in which the conforming adjustment values determined in the conforming adjustment value determination step are normalized; an adjustment-use input value normalization step in which the input values of the image data of the adjustment image are normalized; a LUT extension unit setting step in which a LUT extension unit is set, with the LUT extension unit being a table indicating the relationship between extension unit input values which are values greater than the maximum value that a LUT input value of the LUT can take and extension unit output values which are the corrected values of the extension unit input values; and a LUT calculation step in which the LUT correction data is calculated based on the conforming adjustment values normalized in the conforming adjustment value normalization step, the input values of the image data of the adjustment image normalized in the adjustment-use input value normalization step, the LUT correction data, and the correction data of the LUT extension unit that has been set in the LUT extension unit setting step.

In the LUT adjustment method according to a preferred embodiment of the present invention, furthermore, if the LUT output value corresponding to the maximum value that the LUT input value of the LUT can take does not reach the maximum value that the LUT output value of the LUT can take, and also the conforming adjustment value determined in the conforming adjustment value determination step is greater than the reference adjustment value which is the initial value of the adjustment value applied to the input values of the image data of the adjustment image, then it is desirable that the LUT extension unit be set in the LUT extension unit setting step, and that taking the LUT input values of the LUT and the extension unit input values of the LUT extension unit to be x, the LUT output values before the calculation of the LUT to be y=F(x), the extension unit output values of the LUT extension unit to be H(x), and the LUT output values after the calculation of the LUT to be y=G(x), the LUT output values after the calculation of the LUT y=G(x) be calculated as follows in the LUT calculation step:

(1) over the range $x \le Li_n$:

$$y=G(x)=F(\mathrm{Gain}L_n \times x)$$

(2) over the range $Li_n < x \le Hi_n$:

$$y=G(x)=F((\alpha_n \times \mathrm{Gain}H_n+(1-\alpha_n)\times \mathrm{Gain}L_n)\times x)$$

(3) over the range $Hi_n < x$:

(A) in the case of $\mathrm{Gain}H_n \le 1$:

$$y=G(x)=F(\mathrm{Gain}H_n \times x)$$

(B) in the case of $1 < \mathrm{Gain}H_n$:

(B-1) if F (MAXi)=MAXo, then:

(if the LUT extension unit is not set, then:)

$$y=G(x)=F(a1_n \times x+b1_n)$$

(B-2) if F(MAXi)<MAXo, then:

(if the LUT extension unit is set, then:)

(i) when $\mathrm{Gain}H_n \le Q/\mathrm{MAX}i$:

(i-1) over the range of x where $0 \le \mathrm{Gain}H_n \times x \le \mathrm{MAX}i$:

$$y=G(x)=F(\mathrm{Gain}H_n \times x)$$

(i-2) over the range of x where $\mathrm{MAX}i < \mathrm{Gain}H_n \times x \le Q$:

$$y=G(x)=H(\mathrm{Gain}H_n \times x)$$

(ii) when $Q/\mathrm{MAX}i < \mathrm{Gain}H_n$:

(ii-1) over the range of x where $0 < c_n \times x+d_n \le \mathrm{MAX}i$:

$$y=G(x)=F(c_n \times x+d_n)$$

(ii-2) over the range of x where $\mathrm{MAX}i < c_n \times x+d_n \le Q$:

$$y=G(x)=H(c_n \times x+d_n)$$

(where $\mathrm{Gain}_{ref}$: initial value of the gain (adjustment value) applied to input values of the image data (the reference adjustment value)

$Li_{ref}$: input value of image data of a first adjustment image $Hi_{ref}$: input value of image data of a second adjustment image $(Li_{ref} < Hi_{ref})$ GainL: value of the gain applied to $Li_{ref}$ when the color balance of the first adjustment image becomes a specified color balance (conforming adjustment value)

GainH: value of the gain applied to $Hi_{ref}$ when the color balance of the second adjustment image becomes a specified color balance (conforming adjustment value)

$\mathrm{Gain}L_n=\mathrm{Gain}L/\mathrm{Gain}_{ref}$: normalized value of GainL $\mathrm{Gain}H_n=\mathrm{Gain}H/\mathrm{Gain}_{ref}$: normalized value of GainH $Li_n=Li_{ref} \times \mathrm{Gain}_{ref}$: normalized value of $Li_{ref}$ $Hi_n=Hi_{ref} \times \mathrm{Gain}_{ref}$: normalized value of $Hi_{ref}$ $\alpha_n=(x-Li_n)/(Hi_n-Li_n)$: interpolation coefficient $a1_n=(\mathrm{MAX}o-Ho_n)/(\mathrm{MAX}i-Hi_n)$ $b1_n=Ho_n-Hi_n \times (\mathrm{MAX}o-Ho_n)/(\mathrm{MAX}i-Hi_n)$ $c_n=(Q-Ho_n)/(\mathrm{MAX}i-Hi_n)$ $d_n=Ho_n-Hi_n \times (Q-Ho_n)/(\mathrm{MAX}i-Hi_n)$ $Ho_n=Hi_n \times \mathrm{Gain}H_n$ MAXi: maximum value that the LUT input value x can take in F(x) and G(x)

MAXo: maximum value that F(x) and G(x) can take

Q: maximum value that the extension unit input value x can take in H(x))

With various preferred embodiments of the present invention, the LUT correction data is calculated based on the normalized values of the conforming adjustment values (the values of the gain or offset applied to the input values of the image data of an adjustment image when the color balance of the adjustment image becomes a specified color balance) and the values obtained by normalizing the input values of the image data of the adjustment image. As a result, it is possible to realize appropriate white balance and γ adjustments that match various chromaticity characteristics (desired chromaticity characteristics of various types such as the normal type, cool type, and warm type).

In addition, with various preferred embodiments of the present invention, the LUT correction data is calculated based on the correction data of the LUT extension unit. Consequently, it is possible to realize appropriate white balance and γ adjustments that make appropriate chromaticity corrections possible with respect to high-grayscale images while taking effective advantage of the maximum brightness potential of the display.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

The image display devices and LUT adjustment methods according to preferred embodiments of the present invention will be described below with reference to figures.

First Preferred Embodiment

Figure 1:
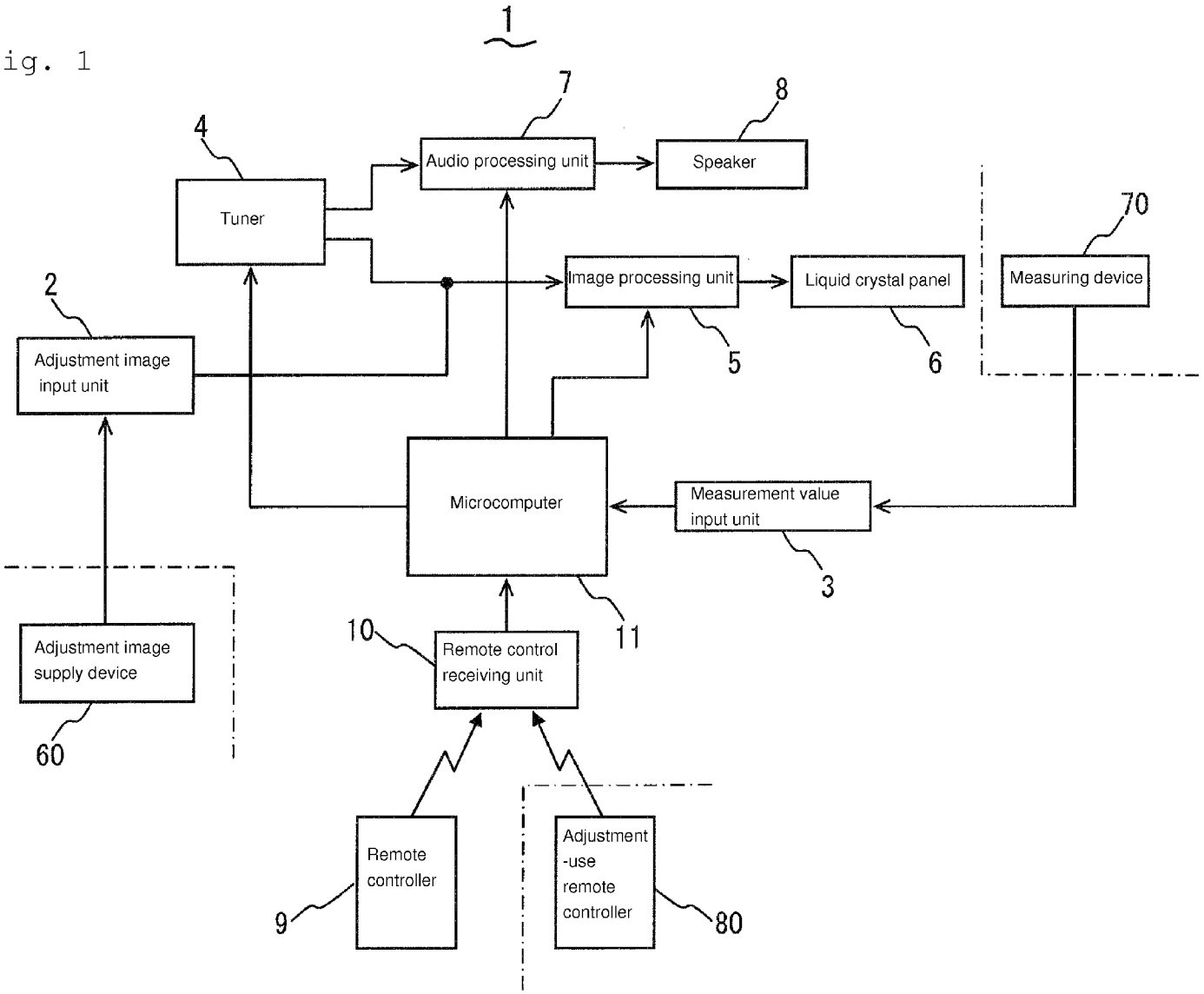
FIG. 1 is an electrical block configuration diagram showing a schematic configuration of an image display device according to a first preferred embodiment of the present invention.

First, the image display device and LUT adjustment method according to a first preferred embodiment will be described. FIG. 1 shows the configuration of the image display device according to the first preferred embodiment. In the present preferred embodiment, the image display device 1 preferably is a television receiver and is a device which receives a television signal broadcasted from a television broadcasting station, displays an image produced from image data based on the television signal, and also outputs audio produced from audio data based on the television signal.

The image display device 1 includes a LUT which is a table of correction data used to correct the chromaticity of a displayed image and is designed to display an image produced from image data based on a television signal after correcting the chromaticity on the basis of the LUT correction data.

Furthermore, the image display device 1 has the function of performing white balance and γ adjustments which adjust the chromaticity characteristics of the displayed image. In various preferred embodiments of the present invention, the white balance and γ adjustments are preferably performed by adjusting (calculating and rewriting) the LUT correction data.

The white balance and γ adjustments are performed by using an adjustment image supply device 60, a measuring device 70, and an adjustment-use remote controller 80 which are external devices. The adjustment image supply device 60 outputs image data of the adjustment image used to perform the white balance and γ adjustments (to calculate the LUT correction data). The measuring device 70 measures the chromaticity of an image which is an object of measurement and outputs the chromaticity measurement value. The adjustment-use remote controller 80 is operated by an adjustment worker (hereinafter referred to as "operator") in order to direct actions of various types when performing the white balance and γ adjustments and transmits an operation signal that indicates the content of the operation by use of infrared light.

The image display device 1 preferably includes an adjustment image input unit 2, a measurement value input unit 3, a tuner 4, an image processing unit 5, a liquid crystal panel 6 constituting the display, an audio processing unit 7, a speaker 8, a remote controller 9, a remote control receiving unit 10, a microcomputer 11 that is programmed to control the actions of the image display device 1, and the like.

The adjustment image input unit 2 is utilized when performing the white balance and γ adjustments and has the adjustment image supply device 60 connected thereto, so the image data of an adjustment image that is output from the adjustment image supply device 60 is input. The measurement value input unit 3 is utilized when performing the white balance and γ adjustments and has the measuring device 70 connected thereto, so the chromaticity measurement value that is output from the measuring device 70 is input.

The tuner 4 receives a television signal broadcasted from a television broadcasting station under the control of the microcomputer 11 and, from the television signal, generates image data based on the television signal and audio data based on the television signal.

Under the control of the microcomputer 11, the image processing unit 5 selectively accepts input of the image data input from the adjustment image input unit 2 or the image data generated by the tuner 4. Then, the image processing unit 5 performs various types of image data processing on the input image data and supplies the processed image data to the liquid crystal panel 6. The liquid crystal panel 6 displays a color image based on the image data supplied from the image processing unit 5.

The audio processing unit 7 performs various types of audio data processing on the audio data generated by the tuner 4 and supplies the processed audio data to the speaker 8. The speaker 8 outputs audio based on the audio data supplied from the audio processing unit 7.

The remote controller 9 is operated by a user in order to direct actions of various types of the image display device 1 and transmits an operation signal that indicates the content of the operation by use of infrared light. The remote control receiving unit 10, upon receiving the operation signal transmitted from the remote controller 9, outputs a remote control reception signal corresponding to the received operation signal (i.e., indicating the content of the operation of the remote controller 9). Moreover, the remote control receiving unit 10, upon receiving the operation signal transmitted from the adjustment-use remote controller 80, outputs a remote control reception signal corresponding to the received operation signal (i.e., indicating the content of the operation of the adjustment-use remote controller 80).

The microcomputer 11 determines the contents of the operation of the remote controller 9 and adjustment-use remote controller 80 based on the remote control reception signals output from the remote control receiving unit 10 and controls actions of various types of the image display device 1. The microcomputer 11 stores various types of data and programs to control the actions of the image display device 1 and controls actions of various types of the image display device 1 based on the programs and various types of data.

Figure 2:
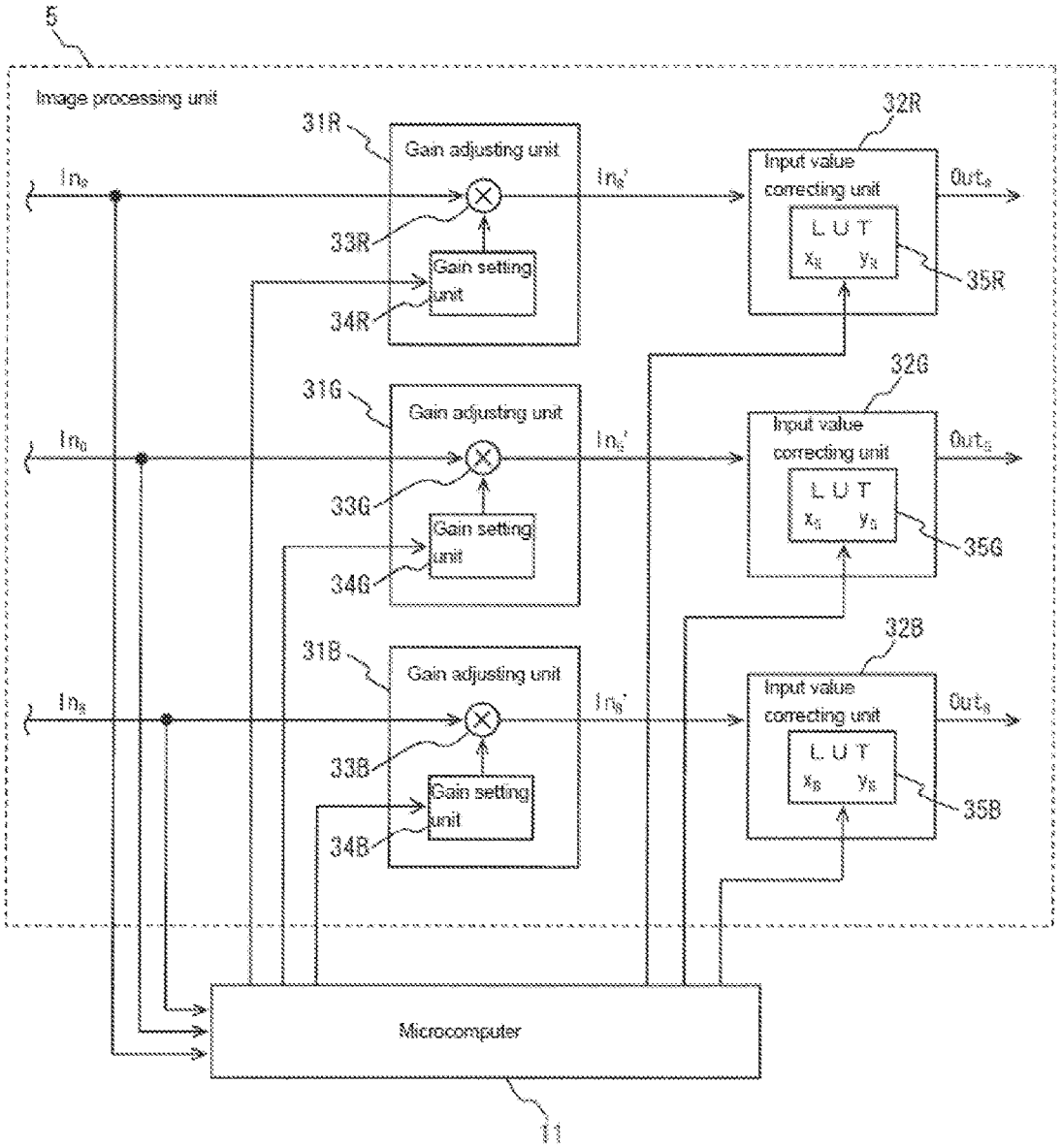
FIG. 2 is an electrical block configuration diagram showing the configuration of the image processing unit of the image display device according to the first preferred embodiment of the present invention.

FIG. 2 shows the electrical block configuration of the image processing unit 5. The image processing unit 5 preferably includes gain adjusting units (input value adjustment unit) 31R, 31G, and 31B and input value correcting units 32R, 32G, and 32B. The image processing unit 5 also preferably includes data processing units of various types (not illustrated).

The image data that is input to the image processing unit 5 is subjected to various types of image data processing by various data processing units (not illustrated), and input values $In_R$, $In_G$, and $In_B$ of the input image data are input to the gain adjusting units 31R, 31G, and 31B. The input value $In_R$ is the input value indicating the intensity level of the color red in the image data, the input value $In_G$ is the input value indicating the intensity level of the color green in the image data, and the input value $In_B$ is the input value indicating the intensity level of the color blue in the image data. The input value $In_R$ is input to the gain adjusting unit 31R, the input value $In_G$ is input to the gain adjusting unit 31G, and the input value $In_B$ is input to the gain adjusting unit 31B.

The gain adjusting units 31R, 31G, and 31B apply gains to the input values $In_R$, $In_G$, and $In_B$ which indicate the intensity levels of the respective colors red, green, and blue in the image data. The gain adjusting unit 31R includes a multiplier circuit 33R and a gain setting unit 34R, the gain adjusting unit 31G includes a multiplier circuit 33G and a gain setting unit 34G, and the gain adjustment unit 31B includes a multiplier circuit 33B and a gain setting unit 34B.

The gain adjusting unit 31R uses the multiplier circuit 33R to multiply the input value $In_R$ indicating the intensity level of the color red by the value of the gain set in the gain setting unit 34R, so as to apply a gain to the input value $In_R$ indicating the intensity level of the color red. The gain adjusting unit 31G uses the multiplier circuit 33G to multiply the input value $In_G$ indicating the intensity level of the color green by the value of the gain set in the gain setting unit 34G, so as to apply a gain to the input value $In_G$ indicating the intensity level of the color green. The gain adjusting unit 31B uses the multiplier circuit 33B to multiply the input value $In_B$ indicating the intensity level of the color blue by the value of the gain set in the gain setting unit 34B, so as to apply a gain to the input value $In_B$ indicating the intensity level of the color blue.

The input values $In_R'$, $In_G'$, and $In_B'$ of the image data to which gains have been applied by the gain adjusting units 31R, 31G, and 31B (the output values of the gain adjusting units 31R, 31G, and 31B) are input to the input value correcting units 32R, 32G, and 32B. If the values of the gain applied by the gain setting units 34R, 34G, and 34B (and set in the gain setting units 34R, 34G, and 34B) are taken to be $G_R$, $G_G$, and $G_B$, the input values $In_R'$, $In_G'$, and $In_B'$ are $In_R'=In_R\times G_R$, $In_G'=In_G\times G_G$, and $In_B'=In_B\times G_B$.

The input value correcting units 32R, 32G, and 32B are units intended to correct the color balance (chromaticity) of images displayed on the liquid crystal panel 6. The input value correcting unit 32R includes a LUT 35R, the input value correcting unit 32G includes a LUT 35G, and the input value correcting unit 32B includes a LUT 35B.

The LUTs 35R, 35G, and 35B are tables of correction data used to correct the color balance of images displayed on the liquid crystal panel 6. Specifically, the LUTs 35R, 35G, and 35B are tables of correction data used to correct the input values $In_R'$, $In_G'$, and $In_B'$ of the image data to which gains have been applied by the gain adjusting units 31R, 31G, and 31B, being tables that indicate the relationships between the LUT input values which are uncorrected values and the LUT output values which are the corrected values of the LUT input values.

The correction data of the LUTs 35R, 35G, and 35B includes data indicating the relationships between the LUT input values which indicate the intensity levels of the respective colors red, green, and blue before correction and the LUT output values which indicate the intensity levels that should be output after correcting the LUT input values. Specifically, the correction data of the LUT 35R includes data indicating the relationship between the LUT input values $x_R$ which indicate the intensity levels of the color red before correction and the LUT output values $y_R=F_R(x_R)$ which indicate the intensity levels of the color red that should be output after correcting the LUT input values $x_R$. Likewise, the correction data of the LUT 35G includes data indicating the relationship between the LUT input values $x_G$ which indicate the intensity levels of the color green before correction and the LUT output values $y_G=F_G(x_G)$ which indicate the intensity levels of the color green that should be output after correcting the LUT input values $x_G$. In addition, the correction data of the LUT 35B includes data indicating the relationship between the LUT input values $x_B$ which indicate the intensity levels of the color blue before correction and the LUT output values $y_R=F_B(x_B)$ which indicate the intensity levels of the color blue that should be output after correcting the LUT input values $x_R$.

Figure 3:
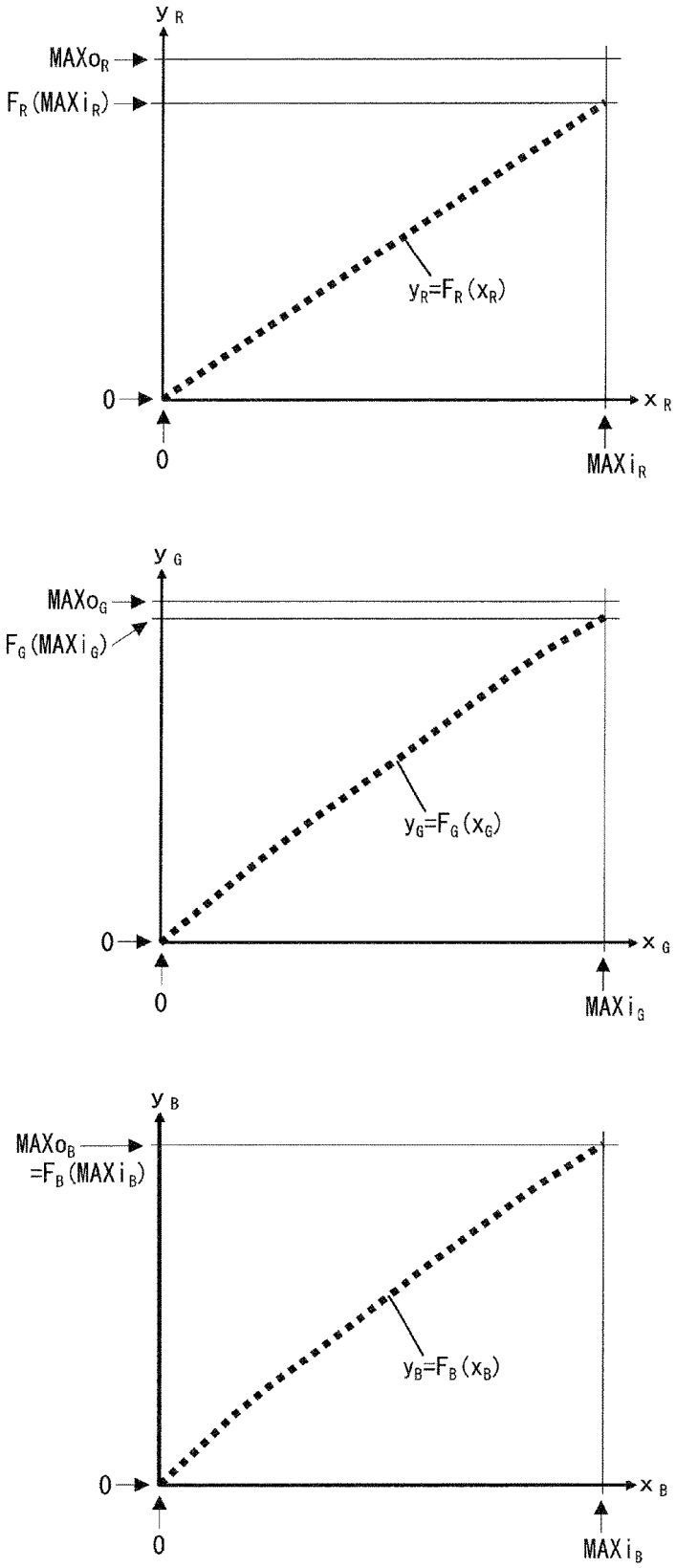
FIG. 3 constitutes diagrams showing an example of the correction data of the LUTs of the image display device according to the first preferred embodiment of the present invention.

FIG. 3 shows an example of the correction data of the LUT 35R, the correction data of the LUT 35G, and the correction data of the LUT 35B. $MAXi_R$, $MAXi_G$, and $MAXi_B$ are the maximum values that the LUT input values $x_R$, $x_G$, and $x_B$ can take (that can be input), while $MAXo_R$, $MAXo_G$, and $MAXo_B$ are the maximum values that the LUT output values $F_R(x_R)$, $F_G(x_G)$, and $F_B(x_B)$ can take (that can be output). In the illustrated example, the value $F_R(MAXi_R)$ of $F_R(x_R)$ corresponding to $x_R=MAXi_R$ is a value less than $MAXo_R$. Likewise, the value $F_G(MAXi_G)$ of $F_G(x_G)$ corresponding to $x_G=MAXi_G$ is a value less than $MAXo_G$. Furthermore, the value $F_B(MAXi_B)$ of $F_B(x_B)$ corresponding to $x_B=MAXi_B$ is equal to $MAXo_B$.

The input value correcting units 32R, 32G, and 32B correct the input values $In_R'$, $In_G'$, and $In_B'$ based on the correction data of the LUTs 35R, 35G, and 35B. Specifically, the input value correcting unit 32R refers to the LUT 35R and outputs the LUT output value $y_R$ corresponding to the LUT input value $x_R$, which is equal to the input value $In_R'$, as $Out_R$. Likewise, the input value correcting unit 32G refers to the LUT 35G and outputs the LUT output value $y_G$ corresponding to the LUT input value $x_G$, which is equal to the input value $In_G'$, as $Out_G$. Moreover, the input value correcting unit 32B refers to the LUT 35B and outputs the LUT output value $y_B$ corresponding to the LUT input value $x_B$, which is equal to the input value $In_B'$, as $Out_B$.

The input values $Out_R$, $Out_G$, $Out_B$ of the image data corrected by the input value correcting units 32R, 32G, and 32B based on the correction data of the LUTs 35R, 35G, and 35B (output values from the input value correcting units 32R, 32G, and 32B) are supplied to the liquid crystal panel 6. $Out_R$, $Out_G$, and $Out_B$ constitute $Out_R=F_R(In_R')=F_R(In_R\times G_R)$, $Out_G=F_G(In_G')=F_G(In_G\times G_G)$, and $Out_B=F_B)=F_B(In_B\times G_B)$. The liquid crystal panel 6 displays an image based on the input values $Out_R$, $Out_G$, and $Out_B$ of the image data corrected on the basis of the correction data of the LUTs 35R, 35G, and 35B.

The gain values $G_R$, $G_G$, and $G_B$ in the gain setting units 34R, 34G, and 34B are set under the control of the microcomputer 11. Except for when adjustment images are displayed, the microcomputer 11 sets the gain values $G_R$, $G_G$, and $G_B$ in the gain setting units 34R, 34G, and 34B to the reference adjustment values $Gain_{Rref}$, $Gain_{Gref}$, and $Gain_{Bref}$. The reference adjustment values $Gain_{Rref}$, $Gain_{Gref}$, and $Gain_{Bref}$ are defined as being the gain values $G_R$, $G_G$, and $G_B$ set in advance for each model of the image display device 1 so as to give each model of the image display device 1 the desired chromaticity characteristics, or namely the initial values of the gain values $G_R$, $G_G$, and $G_B$.

Next, white balance and γ adjustments will be described. In various preferred embodiments of the present invention, white balance and γ adjustments are preferably performed by adjusting (calculating and rewriting) the correction data of the LUTs 35R, 35G, and 35B.

Adjustment of the correction data of the LUTs 35R, 35G, and 35B is performed by calculating and rewriting the correction data of the LUTs 35R, 35G, and 35B based on the reference adjustment values $Gain_{Rref}$, $Gain_{Gref}$, and $Gain_{Bref}$ of the gains in the gain setting units 34R, 34G, and 34B, the input values $In_R$, $In_G$, and $In_B$ of the image data of adjustment images (white (uncolored) images having a specified intensity level), and the gain values $G_R$, $G_G$, and $G_B$ that are applied to the input values $In_R$, $In_G$, and $In_B$ of the image data of the adjustment images such that the color balance of the adjustment images becomes the desired color balance.

In the present preferred embodiment, two adjustment images having different intensity levels are used as the adjustment images. Of the two different adjustment images, the adjustment image with a lower intensity level is referred to as the L adjustment image (first adjustment image), and the adjustment image with a higher intensity level is referred to as the H adjustment image (second adjustment image). The input values $In_R$, $In_G$, and $In_B$ which indicate the intensity levels of the respective colors red, green, and blue in the image data of the L adjustment image are designated as $Li_{Rref}$, $Li_{Gref}$, and $Li_{Bref}$, while the input values $In_R$, $In_G$, and $In_B$ which indicate the intensity levels of the respective colors red, green, and blue in the image data of the H adjustment image are designated as $Hi_{Rref}$, $Hi_{Gref}$, and $Hi_{Bref}$. Here, $Li_{Rref}<Hi_{Rref}$, $Li_{Gref}<Hi_{Gref}$, and $Li_{Bref}<Hi_{Bref}$.

Then, the gain values $G_R$, $G_G$, and $G_B$ that are applied to the input values $Li_{Rref}$, $Li_{Gref}$, and $Li_{Bref}$ of the image data of the L adjustment image when the color balance of the L adjustment image displayed on the liquid crystal panel 6 becomes the desired color balance are referred to as L conforming adjustment values $GainL_R$, $GainL_G$, and $GainL_B$. Likewise, the gain values $G_R$, $G_G$, and $G_B$ that are applied to the input values $Hi_{Rref\ r}$ $Hi_{Gref}$, and $Hi_{Bref}$ of the image data of the H adjustment image when the color balance of the H adjustment image displayed on the liquid crystal panel 6 becomes the desired color balance are referred to as H conforming adjustment values $GainH_R$, $GainH_G$, and $GainH_B$.

In addition, in the present preferred embodiment, the normalized values of the L conforming adjustment values $GainL_R$, $GainL_G$, and $GainL_B$ are designated as $GainL_{Rn}$, $GainL_{Gn}$, and $GainL_{Bn}$, while the normalized values of the H conforming adjustment values $GainH_R$, $GainH_G$, and $GainH_B$ are designated as $GainH_{Rn}$, $GainH_{Gn}$, and $GainH_{Bn}$.

Normalizing the L conforming adjustment value $GainL_R$ is defined as dividing the L conforming adjustment value $GainL_R$ by the reference adjustment value $Gain_{Rref}$. To wit, the normalized value $GainL_{Rn}$ of the L conforming adjustment value $GainL_R$ (normalization of the L conforming adjustment value $GainL_R$) is defined as being the value of the L conforming adjustment value $GainL_R$ divided by the reference adjustment value $Gain_{Rref}$, so $GainL_R=GainL_R/Gain_{Rref}$. The same applies to the normalization of the L conforming adjustment values $GainL_G$ and $GainL_B$, and thus $GainL_{Gn}=GainL_G/Gain_{Gref}$ and $GainL_{Bn}=GainL_B/Gain_{Bref}$.

Likewise, normalizing the H conforming adjustment value $GainH_R$ is defined as dividing the H conforming adjustment value $GainH_R$ by the reference adjustment value $Gain_{Rref}$. To wit, the normalized value $GainH_{Rn}$ of the H conforming adjustment value $GainH_R$ (normalization of the H conforming adjustment value $GainH_R$) is defined as being the value of the H conforming adjustment value $GainH_R$ divided by the reference adjustment value $Gain_{Rref}$, so $GainH_{Rn}=GainH_R/Gain_{Rref}$. The same applies to the normalization of the H conforming adjustment values $GainH_G$ and $GainH_B$, and thus $GainH_{Gn}=GainH_G/Gain_{Gref}$ and $GainH_{Bn}=GainH_B/Gain_{Bref}$.

Furthermore, in the present preferred embodiment, the normalized values of the input values $Li_{Rref}$, $Li_{Gref}$, and $Li_{Bref}$ of the image data of the L adjustment image are designated as $Li_{Rn}$, $Li_{Gn}$, and $Li_{Bn}$, while the normalized values of the input values $Hi_{Rref}$, $Hi_{Gref}$, and $Hi_{Bref}$ of the image data of the H adjustment image are designated as $Hi_{Rn}$, $Hi_{Gn}$, and $Hi_{Bn}$.

Normalizing the input value $Li_{Rref}$ of the image data of the L adjustment image is defined as multiplying the input value $Li_{Rref}$ of the image data of the L adjustment image by the reference adjustment value $Gain_{Rref}$. To wit, the normalized value $Li_{Rn}$ of the input value $Li_{Rref}$ of the image data of the L adjustment image (normalization of the input value $Li_{Rref}$ of the image data of the L adjustment image) is defined as being the input value $Li_{Rref}$ of the image data of the L adjustment image multiplied by the reference adjustment value $Gain_{Rref}$, so $Li_{Rn}=Li_{Rref}\times Gain_{Rref}$. The same applies to the normalization of the input values $Li_{Gref}$ and $Li_{Bref}$ of the image data of the L adjustment image, and thus $Li_{Gn}=Li_{Gref}\times Gain_{Gref}$ and $Li_{Bn}=Li_{Bref}\times Gain_{Bref}$.

Likewise, normalizing the input value $Hi_{Rref}$ of the image data of the H adjustment image is defined as multiplying the input value $Hi_{Rref}$ of the image data of the H adjustment image by the reference adjustment value $Gain_{Rref}$. To wit, the normalized value $Hi_{Rn}$ of the input value $Hi_{Rref}$ of the image data of the H adjustment image (normalization of the input value $Hi_{Rref}$ of the image data of the H adjustment image) is defined as being the input value $Hi_{Rref}$ of the image data of the H adjustment image multiplied by the reference adjustment value $Gain_{Rref}$, so $Hi_{Rn}=Hi_{Rref}\times Gain_{Rref}$. The same applies to the normalization of the input values $Hi_{Gref}$ and $Hi_{Bref}$ of the image data of the H adjustment image, and thus $Hi_{Gn}=Hi_{Gref}\times Gain_{Gref}$ and $Hi_{Bn}=Hi_{Bref}\times Gain_{Bref}$.

Moreover, in the present preferred embodiment, in cases where the LUT output values $F_R(x_R)$, $F_G(x_G)$, and $F_B(x_B)$ of the LUTs 35R, 35G, and 35B and the H conforming adjustment values $GainH_R$, $GainH_G$, and $GainH_B$ satisfy specified conditions, a LUT extension unit R, a LUT extension unit G, and a LUT extension unit B are set. Specifically, if the LUT output value $F_R(MAXi_R)$ corresponding to the maximum value $MAXi_R$ that the LUT input value $x_R$ can take is smaller than the maximum value $MAXo_R$ that the LUT output value $F_R(x_R)$ can take, and also the H conforming adjustment value $GainH_R$ is greater than the reference adjustment value $Gain_{Rref}$, then the LUT extension unit R is set. Likewise, if the LUT output value $F_G(MAXi_G)$ corresponding to the maximum value $MAXi_G$ that the LUT input value $x_G$ can take is smaller than the maximum value $MAXo_G$ that the LUT output value $F_G(x_G)$ can take, and also the H conforming adjustment value $GainH_G$ is greater than the reference adjustment value $Gain_{Gref}$, then the LUT extension unit G is set. In addition, if the LUT output value $F_B(MAXi_B)$ corresponding to the maximum value $MAXi_B$ that the LUT input value $x_B$ can take is smaller than the maximum value $MAXo_B$ that the LUT output value $F_B(x_B)$ can take, and also the H conforming adjustment value $GainH_B$ is greater than the reference adjustment value $Gain_{Bref}$, then the LUT extension unit B is set.

The LUT extension unit R, the LUT extension unit G, and the LUT extension unit B are tables used to calculate the correction data of the LUTs 35R, 35G, and 35B, and with values greater than the maximum values that the LUT input values $x_R$, $x_G$, and $x_B$ can take being set as extension unit input values $x_R$, $x_G$, and $x_B$, the LUT extension units are tables that indicate the relationships between the extension unit input values $x_R$, $x_G$, and $x_B$ and extension unit output values $y_R=H_R(x_R)$, $y_G=H_G(x_G)$, and $y_B=H_B(x_B)$ which are the corrected values of the extension unit input values $x_R$, $x_G$, and $x_B$. The LUT extension unit R is a table connected to $y_R=F_R(x_R)$ at $MAXi_R$ and represented by an increasing function (e.g., a linear function) such that the extension unit output values $y_R=H_R(x_R)$ increase as the extension unit input values $x_R$ become larger. The same applies to the LUT extension unit G and the LUT extension unit B.

In the present preferred embodiment, the correction data of the LUTs 35R, 35G, and 35B is calculated based on: (1) the normalized values $GainL_{Rn}$, $GainL_{Gn}$, and $GainL_{Bn}$ of the L conforming adjustment values $GainL_R$, $GainL_G$, and $GainL_B$ and the normalized values $GainH_{Rn}$, $GainH_{Gn}$, and $GainH_{Bn}$ of the H conforming adjustment values $GainH_R$, $GainH_G$, and $GainH_B$; (2) the normalized values $Li_{Rn}$, $Li_{Gn}$, and $Li_{Bn}$ of the input values $Li_{ref}$, $Li_{Gref}$, and $Li_{Bref}$ of the image data of the L adjustment image and the normalized values $Hi_{Rn}$, $Hi_{Gn}$, and $Hi_{Bn}$ of the input values $Hi_{Rref}$, $Hi_{Gref}$, and $Hi_{Bref}$ of the image data of the H adjustment image; (3) the correction data of the LUTs 35R, 35G, and 35B; and (4) the correction data of the LUT extension unit R, LUT extension unit G, and LUT extension unit B.

In the present preferred embodiment, the calculation of the correction data of the LUT 35R is performed by the calculation formulas described below. Specifically, taking the LUT input values of the LUT 35R and the extension unit input values of the LUT extension unit R to be $x_R$, the LUT output values before the calculation of the LUT 35R to be $y_R=F_R(x_R)$, the extension unit output values of the LUT extension unit R to be $H_R(x_R)$, and the LUT output values after the calculation of the LUT 35R to be $y_R=G_R(x_R)$, the LUT output values after the calculation of the LUT 35R $y_R=G_R(x_R)$ are calculated as follows:

(1) over the range $x_R \le Li_{Rn}$:

$$y_R=G_R(x_R)=F_R(GainL_{Rn}\times x_R)$$

(2) over the range $Li_{Rn}<x_R\le Hi_{Rn}$:

$$y_R=G_R(x_R)=F_R((\alpha_{Rn}\times GainH_{Rn}+(1-\alpha_{Rn})\times GainL_R)\times x_R)$$

(3) over the range $Hi_{Rn}<x_R$:

(A) in the case of $GainH_{Rn}\le 1$:

$$y_R=G_R(x_R)=F_R(GainH_{Rn}\times x_R)$$

(B) in the case of $1<GainH_{Rn}$:

(B-1) if $F_R(MAXi_R)=MAXo_R$, then:

(if the LUT extension unit R is not set, then:)

$$y_R=G_R(x_R)=F_R(a1_{Rn}\times x_R+b1_{Rn})$$

(B-2) if $F_R(MAXi_R)<MAXo_R$, then:

(if the LUT extension unit R is set, then:)

(i) when $GainH_{Rn}\le Q_R/MAXi_R$:

(i-1) over the range of $x_R$ where $0\le GainH_R\times x_R\le MAXi_R$:

$$y_R=G_R(x_R)=F_R(GainH_{Rn}\times x_R)$$

(i-2) over the range of $x_R$ where $MAXi_R<GainH_R\times x_R\le Q_R$:

$$y_R=G_R(x_R)=H_R(GainH_{Rn}\times x_R)$$

(ii) when $Q_R/MAXi_R<GainH_{Rn}$:

(ii-1) over the range of $x_R$ where $0<c_R\times x_R+d_R\le MAXi_R$:

$$y_R=G_R(x_R)=F_R(c_{Rn}\times x_R+d_{Rn})$$

(ii-2) over the range of $x_R$ where $MAXi_R<c_{Rn}\times x_R+d_{Rn}\le Q_R$:

$$y_R=G_R(x_R)=H_R(c_{Rn}\times x_R+d_{Rn})$$

(where $Gain_{Rref}$: initial value of the gain (adjustment value) applied to input values of the image data (the reference adjustment value)

$Li_{Rref}$: input value of image data of a first adjustment image $Hi_{Rref}$: input value of image data of a second adjustment image $(Li_{Rref}<Hi_{Rref})$ $GainL_R$: value of the gain applied to $Li_{Rref}$ when the color balance of the first adjustment image becomes a specified color balance (conforming adjustment value)

$GainH_R$: value of the gain applied to $Hi_{Rref}$ when the color balance of the second adjustment image becomes a specified color balance (conforming adjustment value)

$GainL_{Rn}=GainL_R/Gain_{Rref}$: normalized value of $GainL_R$ $GainH_{Rn}=GainH_R/Gain_{Rref}$: normalized value of $GainH_R$ $Li_{Rn}=Li_{Rref}\times Gain_{Rref}$: normalized value of $Li_{Rref}$ $Hi_{Rn}=Hi_{Rref}\times Gain_{Rref}$: normalized value of $Hi_{Rref}$ $\alpha_{Rn}=(x_R-Li_{Rn})/(Hi_{Rn}-Li_{Rn})$ interpolation coefficient $a1_R=(MAXo_R-Ho_{Rn})/(MAXi_R-Hi_{Rn})$ $b1_{R=Rn}\times(MAXo_R-Ho_{Rn})/(MAXi_R-Hi_{Rn})$ $c_{Rn}=(Q_R-Ho_{Rn})/(MAXi_R-Hi_{Rn})$ $d_{Rn}=Ho_{Rn}-Hi_{Rn}\times(Q_R-Ho_{Rn})/(MAXi_R-Hi_{Rn})$ $Ho_{Rn}=Hi_{Rn}\times GainH_{Rn}$ $MAXi_R$: maximum value that the LUT input value $x_R$ can take in $F_R(x_R)$ and $G_R(x_R)$ $MAXo_R$: maximum value that $F_R(x_R)$ and $G_R(x_R)$ can take $Q_R$: maximum value that the extension unit input value $x_R$ can take in $H_R(x_R)$)

Furthermore, the calculation of the correction data of the LUT 35G is also performed by using similar calculation formulas. Specifically, taking the LUT input values of the LUT 35G and the extension unit input values of the LUT extension unit G to be $x_G$, the LUT output values before the calculation of the LUT 35G to be $y_G=F_G(x_G)$, the extension unit output values of the LUT extension unit G to be $H_G(x_G)$, and the LUT output values after the calculation of the LUT 35G to be $y_G=G_G(x_G)$, the LUT output values after the calculation of the LUT 35G $y_G=G_G(x_G)$ are calculated by use of similar calculation formulas (calculation formulas in which the subscript "R" is replaced with "G").

Likewise, the calculation of the correction data of the LUT 35B is also performed by use of similar calculation formulas. Specifically, taking the LUT input values of the LUT 35B and the extension unit input values of the LUT extension unit B to be $x_B$, the LUT output values before the calculation of the LUT 35B to be $y_B=F_B(x_B)$, the extension unit output values of the LUT extension unit B to be $H_B(x_B)$, and the LUT output values after the calculation of the LUT 35B to be $y_B=G_B(x_B)$, the LUT output values after the calculation of the LUT 35B $y_B=G_B(x_B)$ are calculated by use of similar calculation formulas (calculation formulas in which the subscript "R" is replaced with "B").

Figure 4:
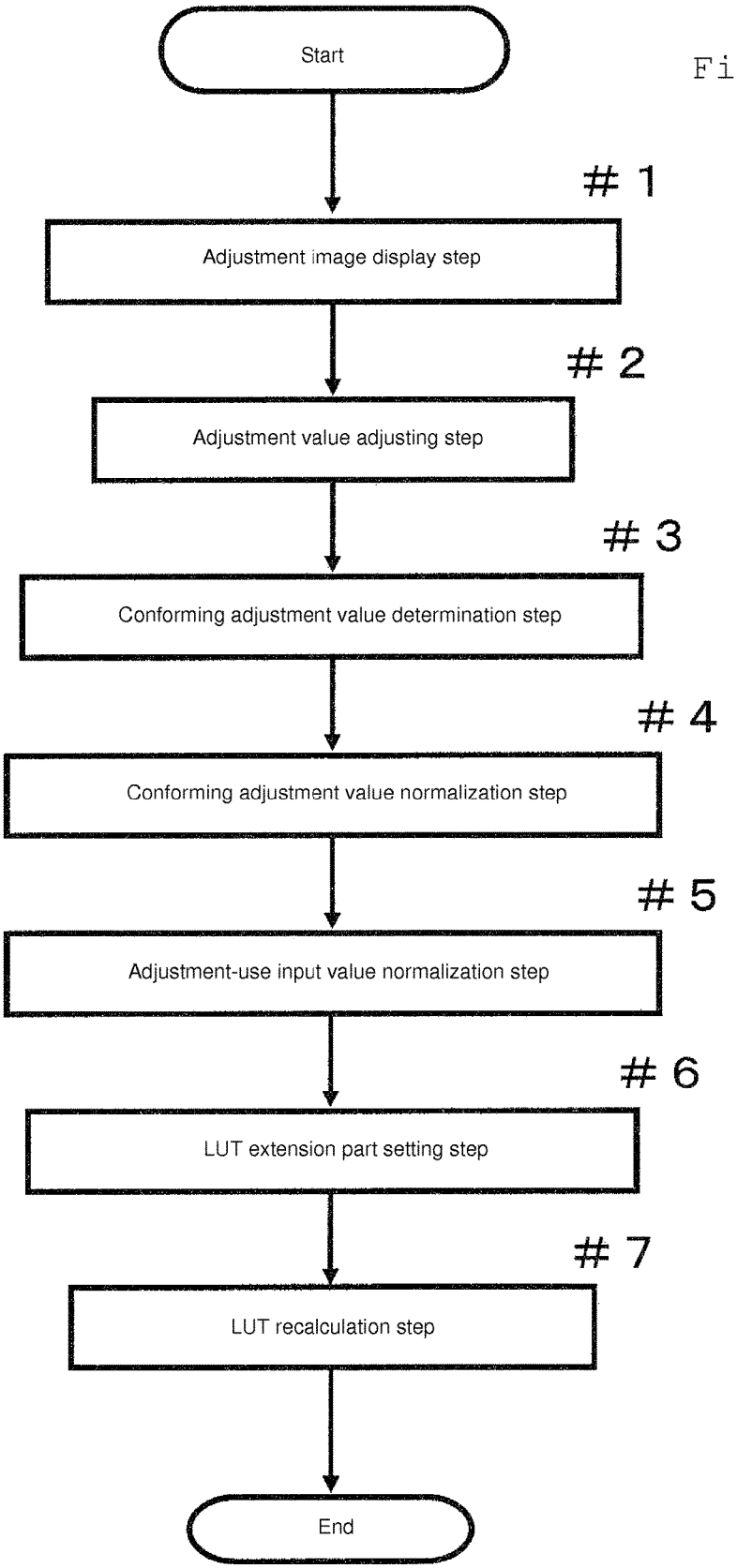
FIG. 4 is a flowchart showing the LUT adjustment method of the image display device according to the first preferred embodiment of the present invention.

FIG. 4 shows a flowchart of the LUT adjustment method (method for adjusting the correction data of the LUTs 35R, 35G, and 35B). The LUT adjustment method includes an adjustment image display step (#1), an adjustment value adjusting step (#2), a conforming adjustment value determination step (#3), a conforming adjustment value normalization step (#4), an adjustment-use input value normalization step (#5), a LUT extension unit setting step (#6), and a LUT calculation step (#7).

The adjustment of the correction data of the LUTs 35R, 35G, and 35B is performed as follows. First, the operator connects an adjustment image supply device 60 to the adjustment image input unit 2 and also connects the measuring device 70 to the measured value input unit 3.

Next, the operator operates the equipment such that the image data of the L adjustment image is output from the adjustment image supply device 60. Consequently, the image data of the L adjustment image is input from the adjustment image input unit 2, and gains are applied by the gain adjusting units 31R, 31G, and 31B to the input values $Li_{Rref}$, $Li_{Gref}$, and $Li_{Bref}$ which indicate the intensity levels of the respective colors red, green, and blue in the image data of the L adjustment image. Moreover, the input values with gains applied $Lo_R$ ($=Li_{Rref}\times G_R$), $Lo_G$ ($=Li_{Gref}\times G_G$), and $Lo_B$ ($=Li_{Bref}\times G_B$) are corrected based on the correction data of the LUTs 35R, 35G, and 35B. Then, the L adjustment image based on the corrected input values $Out_R$ ($=F_R(Li_{Rref}\times G_R)$) $Out_G$ ($=F_G(Li_{Gref}\times G_G)$) and $Out_B$ ($=F_B\ Li_{Bref}\times G_B)$) is displayed on the liquid crystal panel 6 (adjustment image display step).

At the time, the gain values $G_R$, $G_G$, and $G_B$ applied by the gain adjusting units 31R, 31G, and 31B are the reference adjustment values $Gain_{Rref}$, $Gain_{Gref}$, and $Gain_{Bref}$. At the time, the microcomputer 11 acquires the input values $Li_{Rref}$, $Li_{Gref}$, and $Li_{Bref}$ of the image data of the L adjustment image.

In addition, the operator uses the measuring device 70 to measure the color balance of the L adjustment image displayed on the liquid crystal panel 6. As a result, the measured values of the color balance of the L adjustment image measured by the measuring device 70 are input to the measured value input unit 3.

Here, the operator operates the adjustment-use remote controller 80 to give directions that the conforming adjustment values are determined. As a result, the microcomputer 11 adjusts, based on the measured values of the color balance that are input from the measured value input unit 3, the gain values $G_R$, $G_G$, and $G_B$ in the gain adjusting units 31R, 31G, and 31B (the values of the gain applied to the input values $Li_{Rref}$, $Li_{Gref}$, and $Li_{Bref}$ of the image data of the L adjustment image) such that the measured values of the color balance fall within the stipulated range, or namely such that the color balance of the L adjustment image displayed on the liquid crystal panel 6 becomes the specified color balance (adjustment value adjusting step).

As a result of the gain values $G_R$, $G_G$, and $G_B$ in the gain adjusting units 31R, 31G, and 31B being adjusted, the color balance of the L adjustment image displayed on the liquid crystal panel 6 changes, and the measured values of the color balance that are input to the measured value input unit 3 also change according to the color balance of the L adjustment image displayed on the liquid crystal panel 6.

The microcomputer 11 determines, as the L conforming adjustment values $GainL_R$, $GainL_R$, and $GainL_B$, the gain values $G_R$, $G_G$, and $G_B$ at which the measured values of the color balance fall within the stipulated range, i.e., the gain values $G_R$, $G_G$, and $G_B$ at which the color balance of the L adjustment image displayed on the liquid crystal panel 6 becomes the specified color balance (conforming adjustment value determination step).

Then, the microcomputer 11 acquires the L conforming adjustment values $GainL_R$, $GainL_R$, and $GainL_B$. The microcomputer 11 constitutes the conforming adjustment value acquisition unit.

Afterward, the microcomputer 11 returns the gain values $G_R$, $G_G$, and $G_B$ in the gain adjusting units 31R, 31G, and 31B to the reference adjustment values $Gain_{Rref}$, $Gain_{Gref}$, and $Gain_{Bref}$.

Next, the operator operates the equipment such that the image data of the H adjustment image is output from the adjustment image supply device 60. Consequently, the image data of the H adjustment image is input from the adjustment image input unit 2, and gains are applied by the gain adjusting units 31R, 31G, and 31B to the input values $Hi_{Rref}$, $Hi_{Gref}$, and $Hi_{Bref}$ which indicate the intensity levels of the respective colors red, green, and blue in the image data of the H adjustment image. Furthermore, the input values with gains applied $Ho_R$ ($=Hi_{Rref}\times G_R$), $Ho_G$ ($=Hi_{Gref}\times G_G$), and $Ho_B$ ($=Hi_{Bref}\times G_B$) are corrected based on the correction data of the LUTs 35R, 35G, and 35B. Then, the H adjustment image based on the corrected input values $Out_R=F_R(Hi_{Rref}\times G_R)$ $Out_G$ ($=F_G(Hi_{Gref}\times G_G)$ and $Out_B$ ($=F_B(Hi_{Bref}\times G_B)$) is displayed on the liquid crystal panel 6 (adjustment image display step).

At the time, the gain values $G_R$, $G_G$, and $G_B$ applied by the gain adjusting units 31R, 31G, and 31B are the reference adjustment values $Gain_{Rref}$, $Gain_{Gref}$, and $Gain_{Bref}$. At the time, the microcomputer 11 acquires the input values $Hi_{Rref}$, $Hi_{Gref}$, and $Hi_{Bref}$ of the image data of the H adjustment image.

Moreover, the operator uses the measuring device 70 to measure the color balance of the H adjustment image displayed on the liquid crystal panel 6. As a result, the measured values of the color balance of the H adjustment image measured by the measuring device 70 are input to the measured value input unit 3.

Here, the operator operates the adjustment-use remote controller 80 to give directions that the conforming adjustment values are determined. As a result, the microcomputer 11 adjusts, based on the measured values of the color balance that are input from the measured value input unit 3, the gain values $G_R$, $G_G$, and $G_B$ in the gain adjusting units 31R, 31G, and 31B (the values of the gain applied to the input values $Hi_{Rref}$, $Hi_{Gref}$, and $Hi_{Bref}$ of the image data of the H adjustment image) such that the measured values of the color balance fall within the stipulated range, or specifically such that the color balance of the H adjustment image displayed on the liquid crystal panel 6 becomes the specified color balance (adjustment value adjusting step).

As a result of the gain values $G_R$, $G_G$, and $G_B$ in the gain adjusting units 31R, 31G, and 31B being adjusted, the color balance of the H adjustment image displayed on the liquid crystal panel 6 changes, and the measured values of the color balance that are input to the measured value input unit 3 also change according to the color balance of the H adjustment image displayed on the liquid crystal panel 6.

The microcomputer 11 determines, as the H conforming adjustment values $GainH_R$, $GainH_G$, and $GainH_B$, the gain values $G_R$, $G_G$, and $G_B$ at which the measured values of the color balance fall within the stipulated range, i.e., the gain values $G_R$, $G_G$, and $G_B$ at which the color balance of the H adjustment image displayed on the liquid crystal panel 6 becomes the specified color balance (conforming adjustment value determination step).

Then, the microcomputer 11 acquires the H conforming adjustment values $GainH_R$, $GainH_G$, and $GainH_B$. The microcomputer 11 constitutes the conforming adjustment value acquisition unit.

Thereafter, the microcomputer 11 returns the gain values $G_R$, $G_G$, and $G_B$ in the gain adjusting units 31R, 31G, and 31B to the reference adjustment values $Gain_{Rref}$, $Gain_{Gref}$, and $Gain_{Bref}$.

Next, the microcomputer 11 normalizes the L conforming adjustment values $GainH_R$, $GainL_G$, and $GainL_B$ and the H conforming adjustment values $GainH_R$, $GainH_G$, and $GainH_B$ (conforming adjustment value normalization step). Specifically, the microcomputer 11 calculates $GainL_{Rn}=GainL_R/Gain_{Rref}$ as the normalized value of the L conforming adjustment value $GainL_R$, $GainL_{Gn}=GainL_G/Gain_{Gref}$ as the normalized value of the L conforming adjustment value $GainL_G$, and $GainL_{Bn}=GainL_B/Gain_{Bref}$ as the normalized value of the L conforming adjustment value $GainL_B$. In addition, the microcomputer 11 calculates $GainH_{Rn}=GainH_R/Gain_{Rref}$ as the normalized value of the H conforming adjustment value $GainH_R$, $GainH_{Gn}=GainH_G/Gain_{Gref}$ as the normalized value of the H conforming adjustment value $GainH_G$, and $GainH_{Bn}=GainH_B/Gain_{Bref}$ as the normalized value of the H conforming adjustment value $GainH_B$. The microcomputer 11 constitutes the conforming adjustment value normalization unit.

Next, the microcomputer 11 normalizes the input values $Li_{Rref}$, $Li_{Gref}$, and $Li_{Bref}$ of the image data of the L adjustment image and the input values $Hi_{Rref}$, $Hi_{Gref}$, and $Hi_{Bref}$ of the image data of the H adjustment image (adjustment-use input value normalization step). Specifically, the microcomputer 11 calculates $Li_{Rn}=Li_{Rref}\times Gain_{Rref}$ as the normalized value of the input value $Li_{Rref}$, $Li_{Gn}=Li_{Gref}\times Gain_{Gref}$ as the normalized value of the input value $Li_{Gref}$, and $Li_{Gn}=Li_{Bref}\times Gain_{Bref}$ as the normalized value of the input value $Li_{Bref}$. Likewise, the microcomputer 11 calculates $Hi_{Rn}=Hi_{Rref}\times Gain_{Rref}$ as the normalized value of the input value $Hi_{Rref}$, $Hi_{Gn}=_{Gref}\times Gain_{Gref}$ as the normalized value of the input value $Hi_{Gref}$, and $Hi_{Bn}=Hi_{Bref}\times Gain_{Bref}$ as the normalized value of the input value $Hi_{Bref}$. The microcomputer 11 constitutes the adjustment-use input value normalization unit.

Next, if the LUT output value $F_R(MAXi_R)$ corresponding to the maximum value $MAXi_R$ that the LUT input value $x_R$ can take is smaller than the maximum value $MAXo_R$ that the LUT input value $F_R(x_R)$ can take, and also the conforming adjustment value $GainH_R$ is greater than the reference adjustment value $Gain_{Rref}$, then the microcomputer 11 sets the LUT extension unit R. Likewise, if the LUT output value $F_G(MAXi_G)$ corresponding to the maximum value $MAXi_G$ that the LUT input value $x_G$ can take is smaller than the maximum value $MAXo_G$ that the LUT input value $F_G(x_G)$ can take, and also the conforming adjustment value $GainH_G$ is greater than the reference adjustment value $Gain_{Gref}$, then the microcomputer 11 sets the LUT extension unit G. In addition, if the LUT output value $F_B(MAXi_B)$ corresponding to the maximum value $MAXi_B$ that the LUT input value $x_B$ can take is smaller than the maximum value $MAXo_B$ that the LUT input value $F_B(x_B)$ can take, and also the conforming adjustment value $GainH_B$ is greater than the reference adjustment value $Gain_{Bref}$, then the microcomputer 11 sets the LUT extension unit B. This is the LUT extension unit setting step. The microcomputer 11 constitutes the LUT extension unit setting unit.

Then, the operator operates the adjustment-use remote controller 80 to give directions that the correction data of the LUTs 35R, 35G, and 35B is adjusted. As a result, based on $GainL_{Rn}$ as the normalized value of the L conforming adjustment value $GainL_R$, $GainH_{Rn}$ as the normalized value of the H conforming adjustment value $GainH_R$, $Li_{Rn}$ as the normalized value of the input value $Li_{Rref}$, $Hi_{Rn}$ as the normalized value of the input value $Hi_{Rref}$, the correction data of the LUT 35R, and the correction data of the LUT extension unit R, the microcomputer 11 calculates the correction data of the LUT 35R by use of the aforementioned calculation formulas. Furthermore, the microcomputer 11 similarly calculates the correction data of the LUT 35G and the correction data of the LUT 35B by use of the aforementioned calculation formulas (LUT calculation step). The microcomputer 11 constitutes the LUT calculation unit.

Then, the microcomputer 11 overwrites the correction data of the LUTs 35R, 35G, and 35B with the correction data thus calculated. The adjustment of the correction data of the LUTs 35R, 35G, and 35B is performed in this manner.

Next, an example of calculation of the correction data of the LUTs 35R, 35G, and 35B will be described. The correction data of the LUT 35R, the correction data of the LUT 35G, and the correction data of the LUT 35B may be that illustrated in FIG. 3, for example. Specifically, it is assumed that $MAXi_R$, $MAXi_G$, and $MAXi_B$, which are the maximum values that the LUT input values $x_R$, $x_G$, and $x_B$ can take (that can be input), have the value 1023, while $MAXo_R$, $MAXo_G$, and $MAXo_B$, which are the maximum values that the LUT output values $F_R(x_R)$, $F_G(x_G)$, and $F_B(x_B)$ can take (that can be output), have the value 1023, equal to that of $MAXi_R$, $MAXi_G$, and $MAXi_B$. Moreover, it is assumed that $F_R(MAXi_R)$, which is the value of $F_R(x_R)$ corresponding to $x_R=MAXi_R$, is a value less than $MAXo_R$, that $F_G(MAXi_G)$, which is the value of $F_G(x_G)$ corresponding to $x_G=MAXi_G$, is a value less than $MAXo_G$, and that $F_B(MAXi_B)$, which is the value of $F_B(x_B)$ corresponding to $x_B=MAXi_B$, is equal to $MAXo_B$.

In addition, let the reference adjustment values $Gain_{Rref}$, $Gain_{Gref}$, and $Gain_{Bref}$ of the gain adjusting units 31R, 31G, and 31B be, for example, as follows:

$Gain_{Rref}=0.4883$
$Gain_{Gref}=0.7324$
$Gain_{Bref}=1.0000$

Here, assume that the L adjustment image is displayed with the input values $Li_{Rref}$, $Li_{Gref}$, and $Li_{Bref}$ of the image data of the L adjustment image set as follows:

$Li_{Rref}=304$
$Li_{Gref}=304$
$Li_{Bref}=304$

Then, assume that the following were obtained as the L conforming adjustment values $GainL_R$, $GainL_G$, and $GainL_B$:

$GainL_R=0.2539$
$GainL_G=0.4589$
$GainL_B=0.6875$

Furthermore, assume that the H adjustment image is displayed with the input values $Hi_{Rref}$, $Hi_{Gref}$, and $Hi_{Bref}$ of the image data of the H adjustment image set as follows:

$Hi_{Rref}=816$
$Hi_{Gref}=816$
$Hi_{Bref}=816$

Then, assume that the following were obtained as the H conforming adjustment values $GainH_R$, $GainH_G$, and $GainH_B$:

$GainH_R=0.5273$
$GainH_G=0.7324$
$GainH_B=1.1953$

If so, then $GainL_{Rn}$, $GainL_{Gn}$, and $GainL_{Bn}$, which are the normalized values of the L conforming adjustment values $GainL_R$, $GainL_G$, and $GainL_B$, become as follows:

$GainL_{Rn}=0.5200$
$GainL_{Gn}=0.6266$
$GainL_{Bn}=0.6875$

Moreover, $GainH_{Rn}$, $GainH_{Gn}$, and $GainH_{Bn}$, which are the normalized values of the H conforming adjustment values $GainH_R$, $GainH_G$, and $GainH_B$, become as follows:

$GainH_{Rn}=1.0799$
$GainH_{Gn}=1.0000$
$GainH_{Bn}=1.1953$

In addition, $Li_{Rn}$, $Li_{Gn}$, and $Li_{Bn}$, which are the normalized values of the input values $Li_{Rref}$, $Li_{Gref}$, and $Li_{Bref}$ of the image data of the L adjustment image, become as follows:

$Li_{Rn}=148$
$Li_{Gn}=222$
$Li_{Bn}=304$

Likewise, $Hi_{Rn}$, $Hi_{Gn}$, and $Hi_{Bn}$, which are the normalized values of the input values $Hi_{Rref}$, $Hi_{Gref}$, and $Hi_{Bref}$ of the image data of the H adjustment image, become as follows:

$Hi_{Rn}=398$
$Hi_{Gn}=597$
$Hi_{Bn}=816$

In this case, when focusing on the LUT output values $F_R(x_R)$ of the LUT 35R and the H conforming adjustment value $GainH_R$, the LUT output value $F_B(MAXi_R)$ is smaller than $MAXo_R$, and the H conforming adjustment value $GainH_R$ is greater than the reference adjustment value $Gain_{Rref}$. Accordingly, the LUT extension unit R is set. Furthermore, when focusing on the LUT output values $F_G(x_G)$ of the LUT 35G and the H conforming adjustment value $GainH_G$, the LUT output value $F_G(MAXi_G)$ is smaller than $MAXo_G$, but the H conforming adjustment value $GainH_G$ is not greater than the reference adjustment value $Gain_{Gref}$. Accordingly, the LUT extension unit G is not set. Moreover, when focusing on the LUT output values $F_B(x_B)$ of the LUT 35B and the H conforming adjustment value $GainH_B$, the H conforming adjustment value $GainH_B$ is greater than the reference adjustment value $Gain_{Bref}$, but the LUT output value $F_B(MAXi_B)$ is not smaller than $MAXo_B$. Accordingly, the LUT extension unit B is not set.

Figure 5:
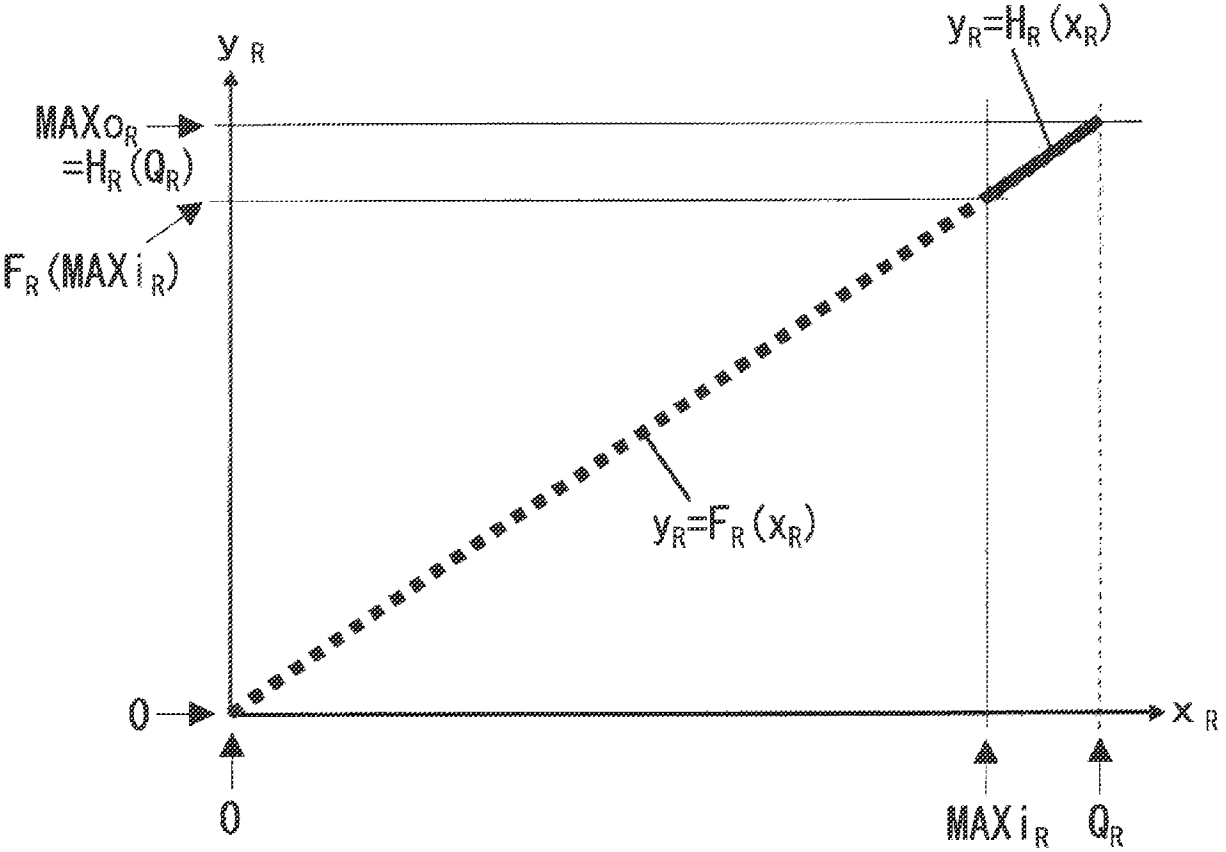
FIG. 5 is a diagram showing an example of the correction data of a LUT extension unit of the image display device according to the first preferred embodiment of the present invention.

FIG. 5 shows an example of the correction data of the LUT extension unit R. The LUT extension unit R is a table connected to $y_R=F_R(x_R)$ at $MAXi_R$ and represented by an increasing function such that the extension unit output values $y_R=H_R(x_R)$ increase as the extension unit input values $x_R$ become larger. In the present preferred embodiment, a linear function, for example, is set as the LUT extension unit R (the same applies to the LUT extension unit G and the LUT extension unit B in cases where the LUT extension unit G and the LUT extension unit B are set). Specifically, in the present preferred embodiment, $y_R=H_R(x_R)$ is a line passing through the point $(MAXi_R, F_R(MAXi_R))$ and having a slope $K_R$ ($K_R>1$), with the following equation:

$$H_R(x_R) = K_R \times (x_R - MAXi_R) + F_R(MAXi_R)$$
$$= K_R \times x_R + F_R(MAXi_R) - K_R \times MAXi_R$$

Here, $K_R$ is set as follows:

$$K_R=(F_R(MAXi_R)-F_R(P_R))/(MAXi_R-P_R)$$

Provided, however, that $P_R$ is an arbitrary value in the range $0 \le P_R < MAXi_R$.

$Q_R$ is the maximum value that the extension unit input value $x_R$ can take, and $H_R(Q_R)$ is the maximum value that the extension unit output value $H_R(x_R)$ can take, so $$H_R(Q_R)=MAXo_R$$

and thus:

$$Q_R=(H_R(Q_R)-F_R(MAXi_R)+MAXi_R \times K_R)/K_R$$

Note that $H_R(Q_R)$ may also be set to $H_R(Q_R)<MAXo_R$ as a countermeasure against difficulties in the high-grayscale portions of the liquid crystal panel 6.

Here, let us provisionally set $i_R=I_R(x_R)$, $i_G=I_G(x_G)$, and $i_B=I_B(x_B)$. The function $i_R=I_R(x_R)$ becomes the values set as the input values $x_R$ of $F_R(x_R)$ or $H_R(x_R)$ when calculating the correction data of the LUT 35R. Likewise, $i_G=I_G(x_G)$ becomes the values set as the input values $x_G$ of $F_G(x_G)$ or $H_G(x_G)$ when calculating the correction data of the LUT 35G. In addition, $i_B=I_B(x_B)$ becomes the values set as the input values $x_B$ of $F_B(x_B)$ or $H_B(x_B)$ when calculating the correction data of the LUT 35B. To wit, $i_R=I_R(x_R)$, $i_G=I_G(x_G)$, and $i_B=I_B(x_B)$ can be considered to be a virtual input/output table with respect to the input side of the LUTs 35R, 35G, and 35B at the time of the calculation of the correction data of the LUTs 35R, 35G, and 35B.

Figure 6:
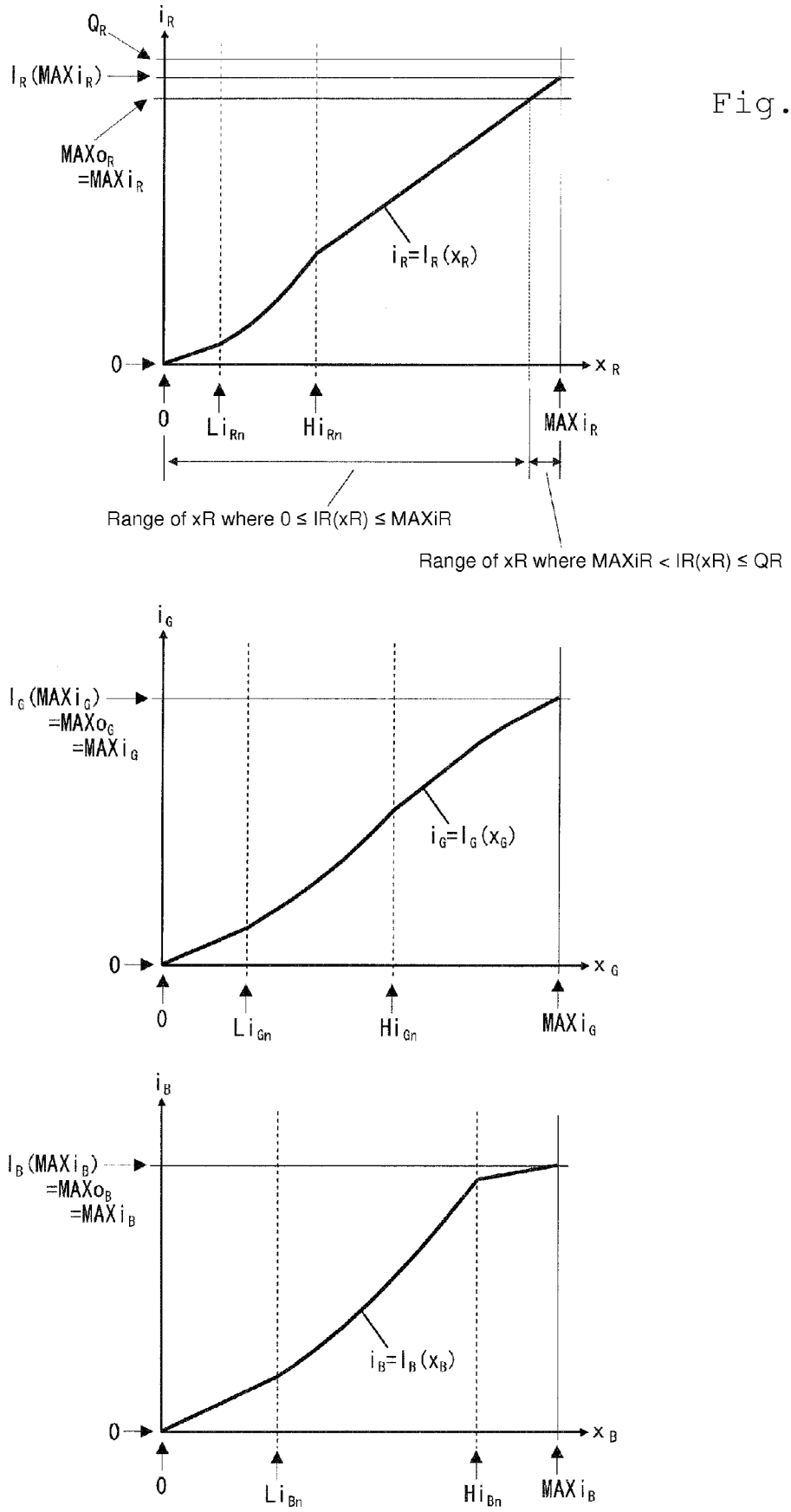
FIG. 6 constitutes diagrams showing a virtual input/output table at the time of the calculation of the correction data of the LUTs of the image display device according to the first preferred embodiment of the present invention.

FIG. 6 shows the functions $i_R=I_R(x_R)$, $i_G=I_G(x_G)$, and $i_B=I_B(x_B)$. In the present preferred embodiment, $I_R(x_R)$ is set as:

(1) over the range $x_R \le Li_{Rn}$:

$$I_R(x_R)=GainL_{Rn} \times x_R$$

(2) over the range $Li_R<x_R \le Hi_{Rn}$ $$I_R(x_R)=(\alpha_{Rn} \times GainH_{Rn}+(1-\alpha_{Rn}) \times GainL_{Rn}) \times x_R$$

(3) over the range $Hi_{Rn}<x_R$:

(A) in the case of $GainH_{Rn} \le 1$:

$$I_R(x_R)=GainH_{Rn} \times x_R$$

(B) in the case of $1<GainH_R$:

(B-1) if the LUT extension unit R is not set, then:

$$I_R(x_R)=a1_{Rn} \times x_R+b1_{Rn}$$

(B-2) if the LUT extension unit 35 is set, then:

(i) when $GainH_{Rn} \le Q_R/MAXi_R$:

$$I_R(x_R)=GainH_{Rn} \times x_R$$

(ii) when $Q_R/MAXi_R<GainH_{Rn}$:

$$I_R(x_R)=c_{Rn} \times x_R+d_{Rn}$$

(where $\alpha_{Rn}=(x_R-Li_{Rn})/(Hi_{Rn}-Li_{Rn})$ interpolation coefficient $$a1_R=(MAXo_R-Ho_{Rn})/(MAXi_R-Hi_{Rn})$$

$$b1_R=Ho_{Rn}-Hi_{Rn} \times (MAXo_R-Ho_{Rn})/(MAXi_R-Hi_{Rn})$$

$$c_{Rn}=(Q_R-Ho_{Rn})/(MAXi_R-Hi_{Rn})$$

$$d_{Rn}=Ho_{Rn}-Hi_{Rn}\times(Q_R-Ho_{Rn})/(\mathrm{MAX}i_R-Hi_{Rn})$$

$$Ho_{Rn}=Hi_{Rn}\times\mathrm{Gain}H_{Rn}$$

$\mathrm{MAX}i_R$: maximum value that the LUT input value $x_R$ can take in $F_R(x_R)$ and $G_R(x_R)$ $\mathrm{MAX}o_R$: maximum value that $F_R(x_R)$ and $G_R(x_R)$ can take $Q_R$: maximum value that the extension unit input value $x_R$ can take in $H_R(x_R)$).

Furthermore, $i_G=I_G(x_G)$ and $i_B=I_B(x_B)$ are also set in the same manner.

In the case, $1<\mathrm{Gain}H_{Rn}$, so the LUT extension unit R is set. Moreover, $\mathrm{Gain}H_{Rn}\leq Q_R/\mathrm{MAX}i_R$. Accordingly, in the case, (3) over the range $Hi_{Rn}<x_R$:

$$I_R(x_R)=\mathrm{Gain}H_{Rn}\times x_R$$

is set.

In addition, in the case, $\mathrm{Gain}H_{Gn}\leq 1$. Accordingly, in the case, (3) over the range $Hi_{Gn}<x_G$:

$$I_G(x_c)=\mathrm{Gain}H_{Gn}\times x_G,$$

is set.

Furthermore, in the case, $1<\mathrm{Gain}H_{Gn}$, so the LUT extension unit B is not set. Accordingly, in the case, (3) over the range $Hi_{Bn}<x_B$:

$$I_B(x_B)=a1_{Bn}\times x_B+b1_{Bn},$$

is set.

Moreover, the LUT output values after calculation of the LUT 35R $y_R=G_R(x_R)$ are calculated as follows:

(i-1) over the range of $x_R$ where $0\leq_R(x_R)\leq\mathrm{MAX}i_R$:

$$y_R=G_R(x_R)=F_R(I_R(x_R))$$

(i-2) over the range of $x_R$ where $\mathrm{MAX}i_R<I_R(x_R)\ Q_R$:

$$y_R=G_R(x_R)=H_R(I_R(x_R))$$

That is, the LUT output values $y_R=G_R(x_R)$ are calculated by use of the aforementioned calculation formulas.

Figure 7:
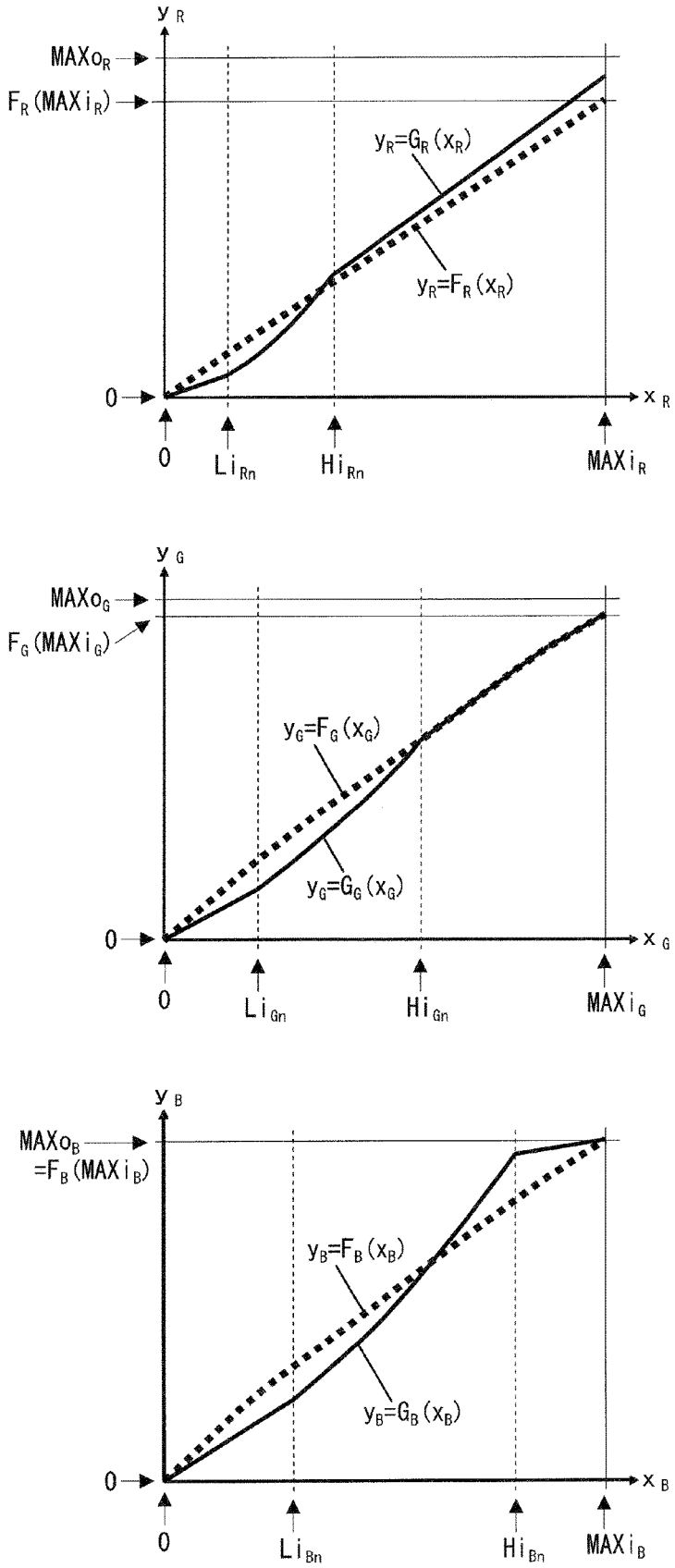
FIG. 7 constitutes diagrams showing an example of the correction data after the calculation of the LUTs of the image display device according to the first preferred embodiment of the present invention.

In addition, the LUT output values after the calculation of the LUT 35G $y_G=G_G(x_G)$ and the LUT output values after the calculation of the LUT 35B $y_B=G_B(x_B)$ are calculated in the same manner. Note that in the case, the LUT extension unit G and the LUT extension unit B are not set, so over all ranges of $x_G$, calculations are performed as $y_G=G_G(x_G)=F_G(I_G(x_G))$, and over all ranges of $x_B$, calculations are performed as $y_B=G_B(x_B)=F_B(I_B(x_B))$ FIG. 7 shows the correction data after the calculation of the LUTs 35R, 35G, and 35B. Here, $y_R=G_R(x_R)$, $y_G=G_G(x_G)$, and $y_B=G_B(x_B)$ illustrate the correction data after calculation, while $y_R=F_R(x_R)$, $y_G=F_G(x_G)$, and $y_B=F_B(x_B)$ illustrate the correction data before calculation. When focusing on the color red ($y_R=F_R(x_R)$ and $y_R=G_R(x_R)$), the intensities become higher with respect to high grayscales (grayscales of $Hi_{Rn}$ or greater). Furthermore, when focusing on the color green ($y_G=F_G(x_G)$ and $y_G=G_G(x_G)$), the intensities do not decrease with respect to high grayscales (grayscales of $Hi_{Gn}$ or greater). Moreover, when focusing on the color blue ($y_B=F_B(x_B)$ and $y_B=G_B(x_B)$), the intensities do not decrease with respect to high grayscales (grayscales of $Hi_{Bn}$ or greater).

With the present preferred embodiment, the correction data of the LUTs 35R, 35G, and 35B is calculated based on the normalized values $\mathrm{Gain}L_n$ of the L conforming adjustment values GainL, the normalized values $\mathrm{Gain}H_n$ of the H conforming adjustment values GainH, the normalized values $Li_n$ of the input values $Li_{ref}$ of the image data of the L adjustment image, and the normalized values $Hi_n$ of the input values $Hi_{ref}$ of the image data of the H adjustment image (subscripts "R," "G," and "B" are omitted). As a result, it is possible to realize appropriate white balance and γ adjustments that match various chromaticity characteristics (desired chromaticity characteristics of various types such as the normal type, cool type, and warm type).

In addition, the correction data of the LUTs 35R, 35G, and 35B is calculated based on the correction data of the LUT extension unit R, LUT extension unit G, and LUT extension unit B. Consequently, it is possible to realize appropriate white balance and γ adjustments that make appropriate chromaticity corrections possible with respect to high-grayscale images while taking effective advantage of the maximum brightness potential of the liquid crystal panel 6.

Second Preferred Embodiment

Figure 8:
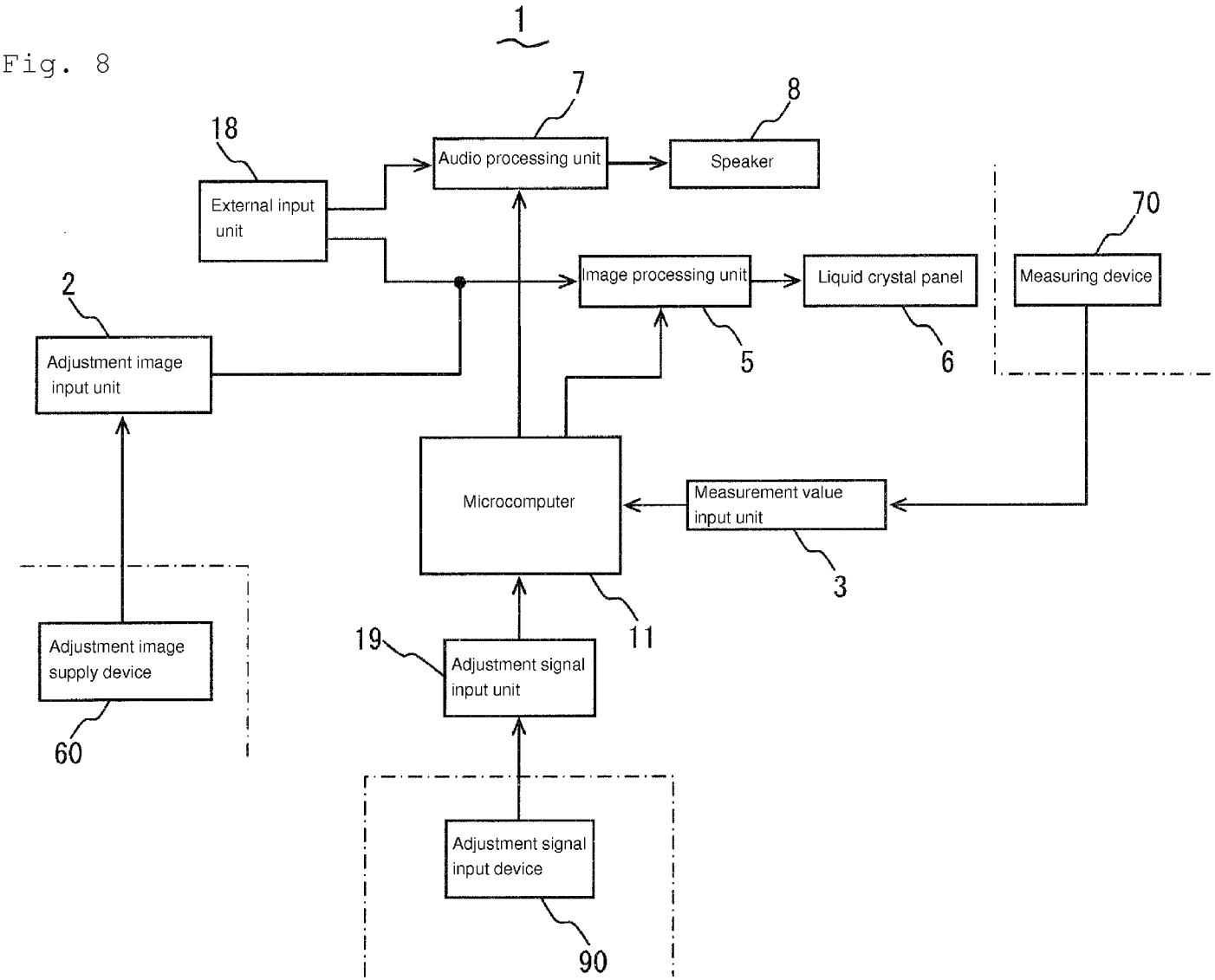
FIG. 8 is an electrical block configuration diagram showing a schematic configuration of the image display device according to a second preferred embodiment of the present invention.

Next, the image display device and LUT adjustment method according to a second preferred embodiment of the present invention will be described. FIG. 8 shows the configuration of the image display device according to the second preferred embodiment. In the present preferred embodiment, the image display device 1 preferably is a device as a single unit display and is a device which is used by connecting an external device such as a personal computer or BD player, displays images based on image data that is input from the external device, and also outputs audio based on audio data that is input from the external device. The image display device 1 is designed to display images based on the image data input from the external device after correcting the chromaticity based on LUT correction data.

In the present preferred embodiment, white balance and γ adjustments are performed by using an adjustment signal input device 90 in place of the adjustment-use remote controller 80. The adjustment signal input device 90 is operated by an adjustment worker in order to direct actions of various types when performing the white balance and γ adjustments and outputs an operation signal indicating the content of the operation.

In the present preferred embodiment, the image display device 1 includes an external input unit 18 in place of the tuner 4 in the first preferred embodiment. Furthermore, the image display device of the present preferred embodiment preferably includes an adjustment signal input unit 19 in place of the remote controller 9 and remote control receiving unit 10.

As a result of an external device such as a personal computer or BD player being connected, the external input unit accepts input of image data and audio data output from the external device.

Under the control of the microcomputer 11, the image processing unit 5 selectively accepts input of the image data that is input from the external input unit 18 or the image data that is generated by the tuner 4. Then, the image processing unit 5 performs various types of image data processing on the input image data and supplies the processed image data to the liquid crystal panel 6. The image processing unit 5 is the same as that in the first preferred embodiment, except that the image data input from the external input unit 18 or the image data generated by the tuner 4 is selectively input (see FIG. 2 and the description thereof).

The audio processing unit 7 performs various types of audio data processing on the audio data that is input from the external input unit 18 and supplies the processed audio data to the speaker 8. The speaker 8 outputs audio based on the audio data supplied from the audio processing unit 7.

The adjustment signal input unit 19 is utilized when the white balance and γ adjustments are performed, and the adjustment signal input device 90 is connected thereto, so an operation signal that is output from the adjustment signal input device 90 is input.

In the present preferred embodiment, the adjustment of the correction data of the LUTs 35R, 35G, and 35B is performed as follows. First, an operator connects the adjustment image supply device 60 to the adjustment image input unit 2, connects the measuring device 70 to the measurement value input unit 3, and connects the adjustment signal input device 90 to the adjustment signal input unit 19.

Then, in place of the operation of the adjustment-use remote controller 80 in the first preferred embodiment, the adjustment signal input device 90 is operated, and the adjustment image display step (#1), adjustment value adjusting step (#2), conforming adjustment value determination step (#3), conforming adjustment value normalization step (#4), adjustment-use input value normalization step (#5), LUT extension unit setting step (#6), and LUT calculation step (#7) are performed in the same manner as in the first preferred embodiment.

The microcomputer 11 calculates the correction data of the LUT 35R, LUT 35G, and LUT 35B in the same manner as in the first preferred embodiment. In the present preferred embodiment, the contents other than those described herein are the same as in the aforementioned first preferred embodiment.

With the present preferred embodiment, appropriate white balance and γ adjustments can be realized in the same manner as in the first preferred embodiment.

Third Preferred Embodiment

Next, the image display device and LUT adjustment method according to a third preferred embodiment will be described. In the present preferred embodiment, the correction data of the LUTs 35R, 35G, and 35B is calculated without setting the LUT extension unit R, LUT extension unit G, and LUT extension unit B in the first preferred embodiment or the second preferred embodiment.

Specifically, in the present preferred embodiment, the correction data of the LUTs 35R, 35G, and 35B is calculated based on: (1) the normalized values $GainL_{Rn}$, $GainL_{Gn}$, and $GainL_{Bn}$ of the L conforming adjustment values $GainL_R$, $GainL_G$, and $GainL_B$ and the normalized values $GainH_{Rn}$, $GainH_{Gn}$, and $GainH_{Bn}$ of the H conforming adjustment values $GainH_R$, $GainH_G$, and $GainH_B$; (2) the normalized values $Li_{Rn}$, $Li_{Gn}$, and $Li_{Bn}$ of the input values $Li_{ref}$, $Li_{Gref}$, and $Li_{Bref}$ of the image data of the L adjustment image and the normalized values $Hi_{Rn}$, $Hi_{Gn}$, and $Hi_{Bn}$ of the input values $Hi_{Rref}$, $Hi_{Gref}$, and $Hi_{Bref}$ of the image data of the H adjustment image; and (3) the correction data of the LUTs 35R, 35G, and 35B.

Specifically, in the present preferred embodiment, the LUT output values after the calculation of the LUT 35R $y_R=G_R(x_R)$ are calculated as follows:

(1) over the range $x_R \le Li_{Rn}$:

$$y_R=G_R(x_R)=F_R(GainL_{Rn}\times x_R)$$

(2) over the range $Li_{Rn}<x_R\le Hi_{Rn}$:

$$y_R=G_R(x_R)=F_R((\alpha_{Rn}\times GainH_{Rn}+(1-\alpha_{Rn})\times GainL_{Rn})\times x_R)$$

(3) over the range $Hi_{Rn}<x_R$:

(A) in the case of $GainH_{Rn}\le 1$:

$$y_R=G_R(x_R)=F_R(GainH_{Rn}\times x_R)$$

(B) in the case of $1<GainH_R$:

$$y_R=G_R(x_R)=F_R(a1_{Rn}\times x+b1_{Rn})$$

(where $Gain_{Rref}$: initial value of the gain value (adjustment value) applied to input values of the image data (the reference adjustment value)

$Li_{Rref}$: input value of image data of a first adjustment image $Hi_{Rref}$: input value of image data of a second adjustment image $(Li_{Rref}<Hi_{Rref})$ $GainL_R$: value of the gain applied to $Li_{Rref}$ when the color balance of the first adjustment image becomes a specified color balance (conforming adjustment value)

$GainH_R$: value of the gain applied to $Hi_{Rref}$ when the color balance of the second adjustment image becomes a specified color balance (conforming adjustment value)

$GainL_{Rn}=GainL_R/Gain_{Rref}$: normalized value of $GainL_R$ $GainH_{Rn}=GainH_R/Gain_{Rref}$: normalized value of $GainH_R$ $Li_{Rn}=Li_{Rref}\times Gain_{Rref}$: normalized value of $Li_{Rref}$ $Hi_{Rn}=Hi_{Rref}\times Gain_{Rref}$: normalized value of $Hi_{Rref}$ $\alpha_{Rn}=(x_R-Li_{Rn})/(Hi_{Rn}-Li_{Rn})$ interpolation coefficient $a1_{Rn}=(MAXo_R-Ho_{Rn})/(MAXi_R-Hi_{Rn})$ $b1_{Rn}=Ho_{Rn}-Hi_{Rn}\times(MAXo_R-Ho_{Rn})/(MAXi_R-Hi_{Rn})$ $Ho_{Rn}=Hi_{Rn}\times GainH_{Rn}$ $MAXi_R$: maximum value that the LUT input value $x_R$ can take in $F_R(x_R)$ and $G_R(x_R)$ $MAXo_R$: maximum value that $F_R(x_R)$ and $G_R(x_R)$ can take)

Moreover, the LUT output values after the calculation of the LUT 35G $y_G=G_G(x_G)$ are calculated by use of similar calculation formulas (calculation formulas in which the subscript "R" is replaced with "G"). Likewise, the LUT output values after the calculation of the LUT 35B, $y_B=G_B(x_B)$ are calculated by use of similar calculation formulas (calculation formulas in which the subscript "R" is replaced with "B").

Figure 9:
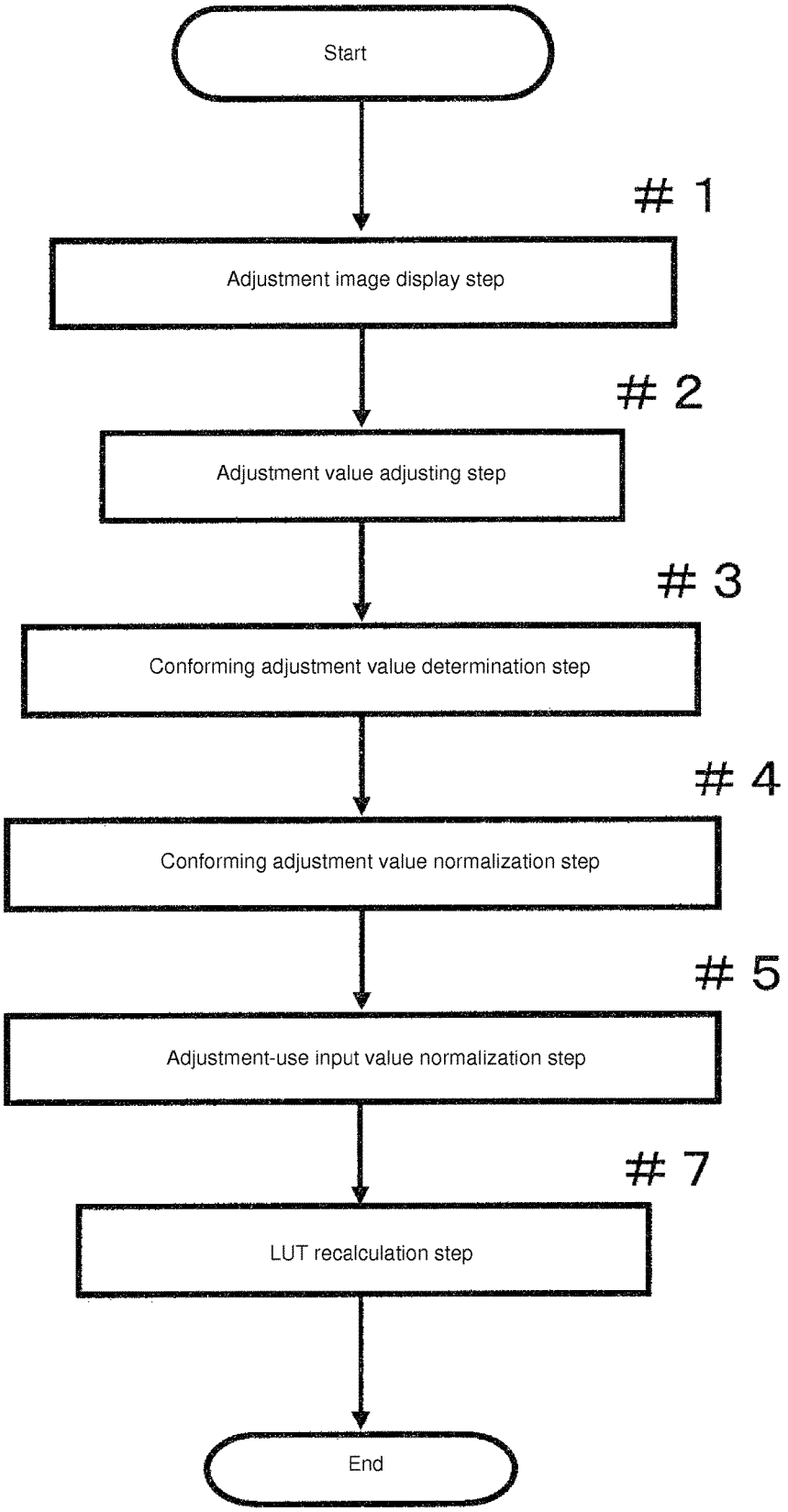
FIG. 9 is a flowchart showing the LUT adjustment method according to a third preferred embodiment of the present invention.

FIG. 9 shows a flowchart of the LUT adjustment method (method for adjusting the correction data of the LUTs 35R, 35G, and 35B) of the present preferred embodiment. The LUT adjustment method of the present preferred embodiment includes the adjustment image display step (#1), adjustment value adjusting step (#2), conforming adjustment value determination step (#3), conforming adjustment value normalization step (#4), adjustment-use input value normalization step (#5), and LUT calculation step (#7).

In the present preferred embodiment, the adjustment of the correction data of the LUTs 35R, 35G, and 35B is performed as follows. First, as in the first preferred embodiment or the second preferred embodiment), the adjustment image display step (#1), adjustment value adjusting step (#2), conforming adjustment value determination step (#3), conforming adjustment value normalization step (#4), and adjustment-use input value normalization step (#5) are performed.

Then, the operator operates the adjustment-use remote controller 80 (or adjustment signal input device 90) to give directions that the correction data of the LUTs 35R, 35G, and 35B is adjusted. Consequently, the microcomputer 11 calculates the correction data of the LUT 35R by use of the aforementioned calculation formulas based on the normalized value $GainL_{Rn}$ of the L conforming adjustment value $GainL_R$, the normalized value $GainH_{Rn}$ of the H conforming adjustment value $GainH_R$, the normalized value $Li_{Rn}$ of the input value $Li_{Rref}$, the normalized value $Hi_{Rn}$ of the input value $Hi_{Rref}$, and the correction data of the LUT 35R unlike the first preferred embodiment or the second preferred embodiment). In addition, the microcomputer 11 calculates the correction data of the LUT 35G and the correction data of the LUT 35B similarly by use of the aforementioned calculation formulas (LUT calculation step #7). In the present preferred embodiment, the contents other than those described herein are the same as in the first preferred embodiment or the second preferred embodiment.

With the present preferred embodiment, the correction data of the LUTs 35R, 35G, and 35B is calculated based on the normalized values $GainL_n$ of the L conforming adjustment values GainL, the normalized values $GainH_n$ of the H conforming adjustment values GainH, the normalized values $Li_n$ of the input values $Li_{ref}$ of the image data of the L adjustment image, and the normalized values $Hi_n$ of the input values $Hi_{ref}$ of the image data of the H adjustment image (subscripts "R," "G," and "B" are omitted). As a result, it is possible to realize appropriate white balance and γ adjustments that match various chromaticity characteristics (desired chromaticity characteristics of various types such as the normal type, cool type, and warm type).

Fourth Preferred Embodiment

Next, the image display device and LUT adjustment method according to a fourth preferred embodiment will be described. In the present preferred embodiment, the correction data of the LUTs 35R, 35G, and 35B is calculated without normalizing the L conforming adjustment values $GainL_R$, $GainL_G$, and $GainL_B$ and the H conforming adjustment values $GainH_R$, $GainH_G$, and $GainH_B$ and also without normalizing the input values $Li_{Rref}$, $Li_{Gref}$, and $Li_{Bref}$ of the image data of the L adjustment image and the input values $Hi_{Rref}$, $Hi_{Gref}$, and $Hi_{Bref}$ of the image data of the H adjustment image.

That is, in the present preferred embodiment, the correction data of the LUTs 35R, 35G, and 35B is calculated based on: (1) the L conforming adjustment values $GainL_R$, $GainL_G$, and $GainL_B$ and the H conforming adjustment values $GainH_R$, $GainH_G$, and $GainH_B$; (2) the input values $Li_{Rref}$, $Li_{Gref}$, and $Li_{Bref}$ of the image data of the L adjustment image and the input values $Hi_{Rref}$, $Hi_{Gref}$, and $Hi_{Bref}$ of the image data of the H adjustment image; (3) the correction data of the LUTs 35R, 35G, and 35B; and (4) the correction data of the LUT extension unit R, LUT extension unit G, and LUT extension unit B.

Specifically, in the present preferred embodiment, the LUT output values after the calculation of the LUT 35R $y_R=G_R(x_R)$ are calculated as follows:

(1) over the range $x_R \le Li_{Ref}$:

$$y_R=G_R(x_R)=F_R(GainL_R \times x_R)$$

(2) over the range $Li_{Ref}<x_R \le Hi_{Ref}$:

$$y_R=G_R(x_R)=F_R((\alpha_R \times GainH_R+(1-\alpha_R) \times GainL_R) \times x_R)$$

(3) over the range $Hi_{Ref}<x_R$:

(A) in the case of $GainH_R \le 1$:

$$y_R=G_R(x_R)=F_R(GainH_R \times x_R)$$

(B) in the case of $1<GainH_R$:

(B-1) if $F_R(MAXi_R)=MAXo_R$, then:

(if the LUT extension unit R is not set, then:)

$$y_R=G_R(x_R)=F_R(a1_R \times x_R+b1_R)$$

(B-2) if $F_R(MAXi_R)<MAXo_R$, then:

(if the LUT extension unit R is set, then:)

(i) when $GainH_R \le Q_R/MAXi_R$:

(i-1) over the range of $x_R$ where $0 \le GainH_R \times x_R \le MAXi_R$:

$$y_R=G_R(x_R)=F_R(GainH_R \times x_R)$$

(i-2) over the range of $x_R$ where $MAXi_R<GainH_R \times x_R \le Q_R$:

$$y_R=G_R(x_R)=H_R(GainH_R \times x_R)$$

(ii) when $Q_R/MAXi_R<GainH_R$:

(ii-1) over the range of $x_R$ where $0<c_R \times x_R+d_R \le MAXi_R$:

$$y_R=G_R(x_R)=F_R(c_R \times x_R+d_R)$$

(ii-2) over the range of $x_R$ where $MAXi_R<c_R \times x_R+d_R \le Q_R$:

$$y_R=G_R(x_R)=H_R(c_R \times x_R+d_R)$$

(where $Li_{Rref}$: input value of image data of a first adjustment image $Hi_{Rref}$: input value of image data of a second adjustment image $(Li_{Rref}<Hi_{Rref})$ $GainL_R$: value of the gain applied to $Li_{Rref}$ when the color balance of the first adjustment image becomes a specified color balance (conforming adjustment value)

$GainH_R$: value of the gain applied to $Hi_{Rref}$ when the color balance of the second adjustment image becomes a specified color balance (conforming adjustment value)

$a_R=(x_R-Li_{Ref})/(Hi_{Rref}-Li_{Rref})$: interpolation coefficient $$a1_R=(MAXo_R-Ho_{Rref})/(MAXi_R-Hi_{Rref})$$

$$b1_R=Ho_{Rref}-Hi_{Rref} \times (MAXo_R-Ho_{Rref})/(MAXi_R-Hi_{Rref})$$

$$c_R=(Q_R-Ho_{Rref})/(MAXi_R-Hi_{Rref})$$

$$d_R=Ho_{Rref}-Hi_{Rref} \times (Q_R-Ho_{Rref})/(MAXi_R-Hi_{Rref})$$

$$Ho_{Rref}=Hi_{Rref} \times GainH_R$$

$MAXi_R$: maximum value that the LUT input value $x_R$ can take in $F_R(x_R)$ and $G_R(x_R)$ $MAXo_R$: maximum value that $F_R(x_R)$ and $G_R(x_R)$ can take $Q_R$: maximum value that the extension unit input value $x_R$ can take in $H_R(x_R)$)

Furthermore, the LUT output values after the calculation of the LUT 35G $y_G=G_G(x_c)$ are calculated by use of similar calculation formulas (calculation formulas in which the subscript "R" is replaced with "G"). Likewise, the LUT output values after the calculation of the LUT 35B, $y_B=G_B(x_B)$ are calculated by use of similar calculation formulas (calculation formulas in which the subscript "R" is replaced with "B").

Figure 10:
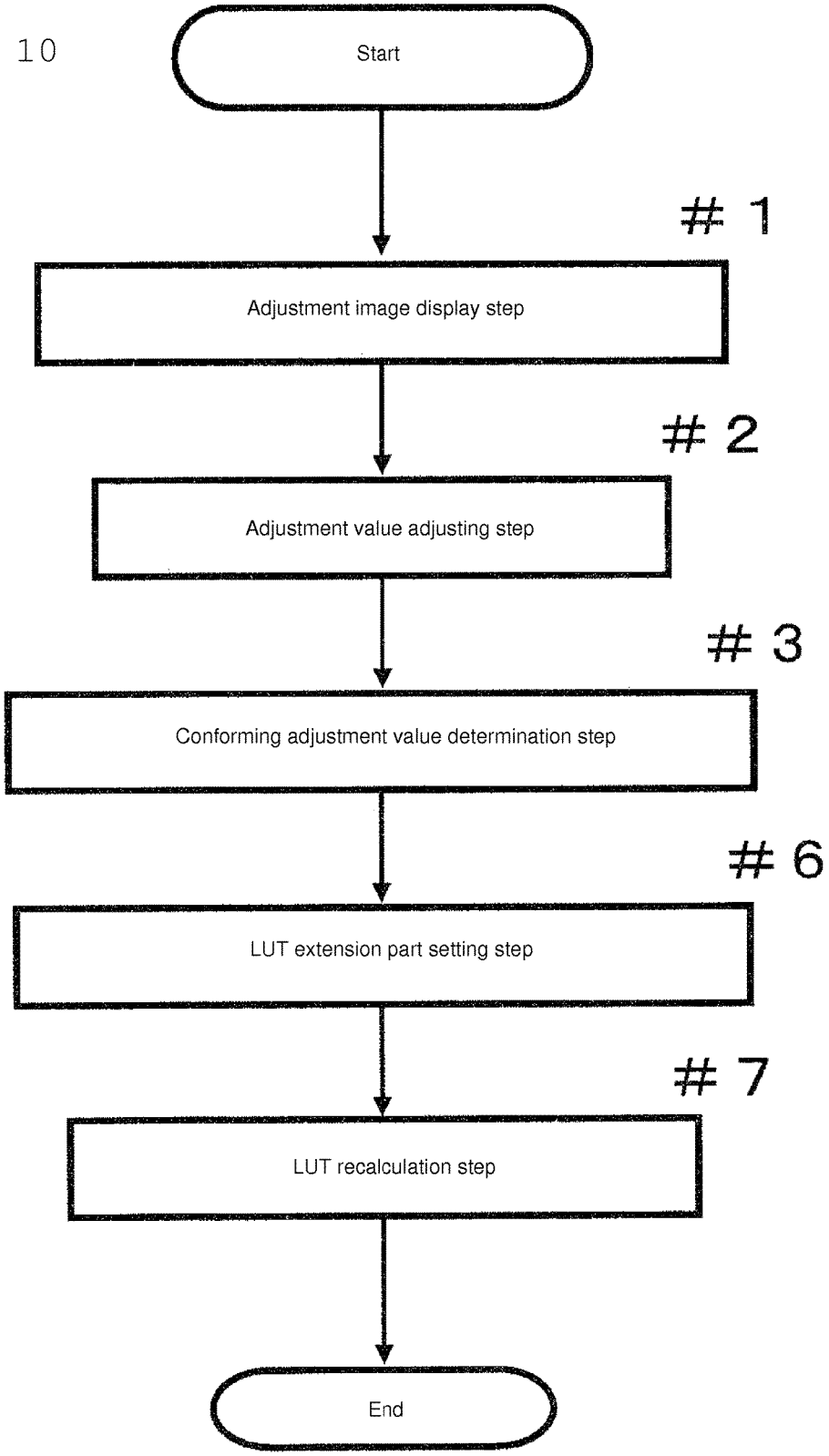
FIG. 10 is a flowchart showing the LUT adjustment method according to a fourth preferred embodiment of the present invention.

FIG. 10 shows a flowchart of the LUT adjustment method (method for adjusting the correction data of the LUTs 35R, 35G, and 35B) of the present preferred embodiment. The LUT adjustment method of the present preferred embodiment includes the adjustment image display step (#1), adjustment value adjusting step (#2), conforming adjustment value determination step (#3), LUT extension unit setting step (#6), and LUT calculation step (#7).

In the present preferred embodiment, the adjustment of the correction data of the LUTs 35R, 35G, and 35B is performed as follows. First, as in the first preferred embodiment or the second preferred embodiment, the adjustment image display step (#1), adjustment value adjusting step (#2), conforming adjustment value determination step (#3), and LUT extension unit setting step (#6) are performed.

Then, the operator operates the adjustment-use remote controller 80 (or adjustment signal input device 90) to give directions that the correction data of the LUTs 35R, 35G, and 35B is adjusted. Consequently, the microcomputer 11 calculates the correction data of the LUT 35R by use of the aforementioned calculation formulas based on the L conforming adjustment value $GainL_R$, the H conforming adjustment value $GainH_R$, the input value $Li_{Rref}$, the input value $Hi_{Rref}$, the correction data of the LUT 35R, and the correction data of the LUT extension unit R unlike the first preferred embodiment or the second preferred embodiment. Moreover, the microcomputer 11 calculates the correction data of the LUT 35G and the correction data of the LUT 35B similarly by use of the aforementioned calculation formulas (LUT calculation step #7). In the present preferred embodiment, the contents other than those described herein are the same as in the first preferred embodiment or the second preferred embodiment.

With the present preferred embodiment, the correction data of the LUTs 35R, 35G, and 35B is calculated based on the correction data of the LUT extension unit R, LUT extension unit G, and LUT extension unit B. As a result, it is possible to realize appropriate white balance and γ adjustments that make appropriate chromaticity corrections possible with respect to high-grayscale images while taking effective advantage of the maximum brightness potential of the liquid crystal panel 6.

Note that the present invention is not limited to the configuration of each of the preferred embodiments described above, and various modifications are possible. For instance, it would also be possible to provide an offset adjusting unit which applies an offset to the adjustment-use input value in place of the gain adjusting unit and to calculate the LUT correction data in the same manner by using, instead of the value of a gain in the gain adjusting unit, the value replacing the value of the gain with the value of the offset in the offset adjusting unit. In addition, the LUT extension units are not limited to a linear function, and a quadratic function or exponential function, for example, is also possible.

Furthermore, the calculation of LUT correction data may also be performed by calculation formulas different from the calculation formulas in the preferred embodiments described above.

For example, in the first preferred embodiment, it is also possible to perform calculations as follows (subscripts "R," "G," and "B" are omitted):

(2) over the range $Li_n<x\leq Hi_n$:

$$y=G(x)=F(a0_n\times x+b0_n)$$

(where $a0_n=(Ho_n-Lo_n)/(Hi_n-Li_n)$ $$b0_n=Lo_n-Li_n\times(Ho_n-Lo_n)/(Hi_n-Li_n)$$

$$Lo_n=Li_n\times GainL_n)$$

Moreover, in the first preferred embodiment, for example, it is also possible to perform calculations as follows (subscripts "R," "G," and "B" are omitted):

(3) over the range $Hi_n<x$:

(B) in the case of $1<GainH_n$:

(B-1) if F(MAXi)=MAXo, then:

(if the LUT extension unit is not set, then:)

$$y=G(x)=F((\beta_n\times 1+(1-\beta_n)\times GainH_n)\times x)$$

(where $\beta_n=(x-Hi_n)/(MAXi-Hi_n)$: interpolation coefficient)

In addition, in the third preferred embodiment, for example, it is also possible to perform calculations as follows (subscripts "R," "G," and "B" are omitted):

(2) over the range $Li_n<x\leq Hi_n$:

$$y=G(x)=F(a0_n\times x+b0_n)$$

(where $a0_n=(Ho_n-Lo_n)/(Hi_n-Li_n)$ $$b0_n=Lo_n-Li_n\times(Ho_n-Lo_n)/(Hi_n-Li_n)$$

$$Lo_n=Li_n\times GainL_n)$$

Furthermore, in the third preferred embodiment, for example, it is also possible to perform calculations as follows (subscripts "R," "G," and "B" are omitted):

(3) over the range $Hi_n<x$:

(B) in the case of $1<GainH_n$:

$$y=G(x)=F((\beta_n\times 1+(1-\beta_n)\times GainH_n)\times x)$$

(where $\beta_n=(x-Hi_n)/(MAXi-Hi_n)$: interpolation coefficient)

Moreover, in the fourth preferred embodiment, for example, it is also possible to perform calculations as follows (subscripts "R," "G," and "B" are omitted):

(2) over the range $Li<x\leq Hi$:

$$y=G(x)=F(a0\times x+b0)$$

(where $a0=(Ho_f-Lo_{ref})/(Hi_{ref}-Li_{ref})$ $$b0=Lo_{ref}-Li_{ref}\times(Ho_{ref}-Lo_{ref})/(Hi_{ref}-Li_{ref})$$

$$Lo_{ref}=Li_{ref}\times GainL)$$

In addition, in the fourth preferred embodiment, for example, it is also possible to perform calculations as follows (subscripts "R," "G," and "B" are omitted):

(3) over the range $Hi<x$:

(B) in the case of $1<GainH$:

(B-1) if F(MAXi)=MAXo, then:

(if the LUT extension unit is not set, then:)

$$y=G(x)=F((\beta\times 1+(1-\beta)\times GainH)\times x)$$

(where $\beta=(x-Hi)/(MAXi-Hi)$: interpolation coefficient)

Furthermore, LUT correction data may also be calculated based on a single adjustment image without being limited to the use of two adjustment images, or LUT correction data may also be calculated based on three or more adjustment images. Moreover, the display for displaying images is not limited to a liquid crystal panel, and a plasma display, CRT display, organic EL display, or the like may also be used. Similar actions and effects are obtained even in cases where the display is a plasma display, CRT display, organic EL display, or the like.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An image display device comprising:

an input value adjustment unit, defined by an image processor, which applies a gain or offset to input values of image data;

a LUT which is a table of correction data used to correct the input values of image data having a gain or offset applied thereto by the input value adjustment unit and which is a table indicating a relationship between LUT input values that are uncorrected values and LUT output values that are corrected values of the LUT input values;

a display which displays images based on the input values of the image data that have been corrected based on the LUT correction data;

a conforming adjustment value acquisition unit which acquires conforming adjustment values, where the conforming adjustment values are defined as being adjustment values which are the values of gain or offset applied to the input values of image data of an adjustment image by the input value adjustment unit when a color balance of the adjustment image displayed on the display becomes a specified color balance;

a LUT extension unit setting unit which sets a LUT extension unit which is a table indicating a relationship between extension unit input values which are values greater than a maximum value that a LUT input value of the LUT can take and extension unit output values which are corrected values of the extension unit input values; and a LUT calculation unit which calculates the LUT correction data based on the conforming adjustment values acquired by the conforming adjustment value acquisition unit, the input values of the image data of the adjustment image, the LUT correction data, and the correction data of the LUT extension unit that has been set by the LUT extension unit setting unit; wherein if the LUT output value corresponding to the maximum value that the LUT input value of the LUT can take does not reach the maximum value that the LUT output value of the LUT can take, and also the conforming adjustment value acquired by the conforming adjustment value acquisition unit is greater than a reference adjustment value which is an initial value of the adjustment value applied by the input value adjustment unit to the input values of the image data of the adjustment image, then the LUT extension unit is set; and the conforming adjustment value acquisition unit, the LUT extension unit setting unit, and the LUT calculation unit setting unit are defined by a microcomputer.

2. The image display device according to claim 1, wherein:

taking the LUT input values of the LUT and the extension unit input values of the LUT extension unit to be x, the LUT output values before calculation of the LUT to be y=F(x), the extension unit output values of the LUT extension unit to be H(x), and the LUT output values after calculation of the LUT to be y=G(x), the LUT calculation unit calculates the LUT output values after calculation of the LUT y=G(x) as follows:

(1) over a range x $$y=G(x)=F(\mathrm{Gain}L\times x)$$

(2) over a range $Li_{ref}<x\leq Hi_{ref}$:

$$y=G(x)=F((\alpha\times \mathrm{Gain}H+(1-\alpha)\times \mathrm{Gain}L)\times x)$$

(3) over a range $Hi_{ref}<x$:

(A) in a case of GainH≤1:

$$y=G(x)=F(\mathrm{Gain}H\times x)$$

(B) in a case of 1<GainH:

(B-1) if F(MAXi)=MAXo, then:

(if the LUT extension unit is not set, then:)

$$y=G(x)=F(a1\times x+b1)$$

(B-2) if F(MAXi)<MAXo, then:

(if the LUT extension unit is set, then:)

(i) when GainH≤Q/MAXi:

(i-1) over a range of x where 0≤GainH×x≤MAXi:

$$y=G(x)=F(\mathrm{Gain}H\times x)$$

(i-2) over a range of x where MAXi<GainH×x≤Q:

$$y=G(x)=H(\mathrm{Gain}H\times x)$$

(ii) when Q/MAXi<GainH:

(ii-1) over a range of x where 0<c×x+d≤MAXi:

$$y=G(x)=F(c\times x+d)$$

(ii-2) over a range of x where MAXi<c×x+d≤Q:

$$y=G(x)=H(c\times x+d)$$

(where $Li_{ref}$: input value of image data of a first adjustment image $Hi_{ref}$: input value of image data of a second adjustment image $(Li_{ref}<Hi_{ref})$ GainL: value of a gain applied to $Li_{ref}$ when a color balance of the first adjustment image becomes a specified color balance (conforming adjustment value)

GainH: value of a gain applied to $Hi_{ref}$ when a color balance of the second adjustment image becomes a specified color balance (conforming adjustment value)

$\alpha=(x-Li_{ref})/(Hi_{ref}-Li_{ref})$: interpolation coefficient $$a1=(\mathrm{MAX}o-Ho_{ref})/(\mathrm{MAX}i-Hi_{ref})$$

$$b1=Ho_{ref}-Hi_{ref}\times(\mathrm{MAX}o-Ho_{ref})/(\mathrm{MAX}i-Hi_{ref})$$

$$c=(Q-Ho_{ref})/(\mathrm{MAX}i-Hi_{ref})$$

$$d=Ho_{ref}-Hi_{ref}\times(Q-Ho_{ref})/(\mathrm{MAX}i-Hi_{ref})$$

$$Ho_{ref}=Hi_{ref}\times \mathrm{Gain}H$$

MAXi: maximum value that the LUT input value x can take in F(x) and G(x)

MAXo: maximum value that F(x) and G(x) can take

Q: maximum value that the extension unit input value x can take in H(x)).

3. The image display device according to claim 1, wherein the input value adjustment unit, the conforming adjustment value acquisition unit, the LUT extension unit setting unit, and the LUT calculation unit are included in and controlled by the microcomputer.

4. A LUT adjustment method implemented by an image processor and a microcomputer, the method comprising:

an adjustment image display step in which an adjustment image is displayed on a color display after applying a gain or offset to input values of image data of the adjustment image and, based on LUT correction data, correcting the input values of image data of the adjustment image to which the gain or offset has been applied;

an adjustment value adjusting step in which the adjustment values that are the values of the gain or offset applied to the input values of the image data of the adjustment image are adjusted such that a color balance of the adjustment image displayed in the adjustment image display step becomes a specified color balance;

a conforming adjustment value determination step in which the adjustment values that have been adjusted in the adjustment value adjusting step and that are the values of the gain or offset applied to the input values of the image data of the adjustment image when the color balance of the adjustment image becomes a specified color balance are determined as conforming adjustment values;

a LUT extension unit setting step in which a LUT extension unit is set, with the LUT extension unit being a table indicating a relationship between extension unit input values which are values greater than a maximum value that a LUT input value of the LUT can take and extension unit output values which are corrected values of the extension unit input values; and a LUT calculation step in which the LUT correction data is calculated based on the conforming adjustment values determined in the conforming adjustment value determination step, the input values of the image data of the adjustment image, the LUT correction data, and the correction data of the LUT extension unit that has been set in the LUT extension unit setting step; wherein if the LUT output value corresponding to the maximum value that the LUT input value of the LUT can take does not reach the maximum value that the LUT output value of the LUT can take, and also the conforming adjustment value determined in the conforming adjustment value determination step is greater than a reference adjustment value which is an initial value of the adjustment value applied to the input values of the image data of the adjustment image, then the LUT extension unit is set in the LUT extension unit setting step.

5. The LUT adjustment method according to claim 4, wherein:

taking the LUT input values of the LUT and the extension unit input values of the LUT extension unit to be x, the LUT output values before the calculation of the LUT to be y=F(x), the extension unit output values of the LUT extension unit to be H(x), and the LUT output values after calculation of the LUT to be y=G(x), the LUT output values after calculation of the LUT y=G(x) are calculated as follows in the LUT calculation step:

(1) over a range x $$y=G(x)=F(\mathrm{Gain}L\times x)$$

(2) over a range $Li_{ref}<x\leq Hi_{ref}$:

$$y=G(x)=F((\alpha\times\mathrm{Gain}H+(1-\alpha)\times\mathrm{Gain}L)\times x)$$

(3) over a range $Hi_{ref}<x$:

(A) in a case of GainH≤1:

$$y=G(x)=F(\mathrm{Gain}H\times x)$$

(B) in a case of 1<GainH:

(B-1) if F(MAXi)=MAXo, then:

(if the LUT extension unit is not set, then:)

$$y=G(x)=F(a1\times x+b1)$$

(B-2) if F(MAXi)<MAXo, then:

(if the LUT extension unit is set, then:)

(i) when GainH≤Q/MAXi:

(i-1) over a range of x where 0≤GainH×x≤MAXi:

$$y=G(x)=F(\mathrm{Gain}H\times x)$$

(i-2) over a range of x where MAXi<GainH×x≤Q:

$$y=G(x)=H(\mathrm{Gain}H\times x)$$

(ii) when Q/MAXi<GainH:

(ii-1) over a range of x where 0<c×x+d≤MAXi:

$$y=G(x)=F(c\times x+d)$$

(ii-2) over a range of x where MAXi<c×x+d≤Q:

$$y=G(x)=H(c\times x+d)$$

(where $Li_{ref}$: input value of image data of a first adjustment image $Hi_{ref}$: input value of image data of a second adjustment image $(Li_{ref}<Hi_{ref})$ GainL: value of a gain applied to $Li_{ref}$ when a color balance of the first adjustment image becomes a specified color balance (conforming adjustment value)

GainH: value of a gain applied to $Hi_{ref}$ when a color balance of the second adjustment image becomes a specified color balance (conforming adjustment value)

$\alpha=(x-Li_{ref})/(Hi_{ref}-Li_{ref})$: interpolation coefficient $$a1=(\mathrm{MAX}o-Ho_{ref})/(\mathrm{MAX}i-Hi_{ref})$$

$$b1=Ho_{ref}-Hi_{ref}\times(\mathrm{MAX}o-Ho_{ref})/(\mathrm{MAX}i-Hi_{ref})$$

$$c=(Q-Ho_{ref})/(\mathrm{MAX}i-Hi_{ref})$$

$$d=Ho_{ref}-Hi_{ref}\times(Q-Ho_{ref})/(\mathrm{MAX}i-Hi_{ref})$$

$$Ho_{ref}=Hi_{ref}\times\mathrm{Gain}H$$

MAXi: maximum value that the LUT input value x can take in F(x) and G(x)

MAXo: maximum value that F(x) and G(x) can take

Q: maximum value that the extension unit input value x can take in H(x)).

6. The LUT adjustment method according to claim 4, wherein the adjustment image display step, the adjustment value adjusting step, the conforming adjustment value determination step, the LUT extension unit setting step, and the LUT calculation step are performed by the microcomputer.

7. An image display device comprising:

an input value adjustment unit, defined by an image processor, which applies a gain or offset to input values of image data;

a LUT which is a table of correction data used to correct the input values of image data having a gain or offset applied thereto by the input value adjustment unit and which is a table indicating a relationship between the LUT input values that are uncorrected values and LUT output values that are corrected values of the LUT input values;

a display which displays images based on the input values of the image data that have been corrected based on the LUT correction data;

a conforming adjustment value acquisition unit which acquires conforming adjustment values, where the conforming adjustment values are defined as being adjustment values which are values of the gain or offset applied to the input values of image data of an adjustment image by the input value adjustment unit when a color balance of the adjustment image displayed on the display becomes a specified color balance;

a conforming adjustment value normalization unit which normalizes the conforming adjustment values acquired by the conforming adjustment value acquisition unit;

an adjustment-use input value normalization unit which normalizes the input values of the image data of the adjustment image;

a LUT extension unit setting unit which sets a LUT extension unit which is a table indicating a relationship between extension unit input values which are values greater than a maximum value that a LUT input value of the LUT can take and extension unit output values which are corrected values of the extension unit input values; and a LUT calculation unit which calculates the LUT correction data based on the conforming adjustment values normalized by the conforming adjustment value normalization unit, the input values of the image data of the adjustment image normalized by the adjustment-use input value normalization unit, the LUT correction data, and the correction data of the LUT extension unit that has been set by the LUT extension unit setting unit; wherein if the LUT output value corresponding to the maximum value that the LUT input value of the LUT can take does not reach the maximum value that the LUT output value of the LUT can take, and also the conforming adjustment value acquired by the conforming adjustment value acquisition unit is greater than a reference adjustment value which is an initial value of the adjustment value applied by the input value adjustment unit to the input values of the image data of the adjustment image, then the LUT extension unit is set; and the conforming adjustment value acquisition unit, the conforming adjustment value normalization unit, the adjustment-use input value normalization unit, the LUT extension unit setting unit, and the LUT calculation unit are defined by a microcomputer.

8. The image display device according to claim 7, wherein:

taking the LUT input values of the LUT and the extension unit input values of the LUT extension unit to be x, the LUT output values before calculation of the LUT to be y=F(x), the extension unit output values of the LUT extension unit to be H(x), and the LUT output values after calculation of the LUT to be y=G(x);

the LUT calculation unit calculates the LUT output values after calculation of the LUT y=G(x) as follows:

(1) over a range $x \le Li_n$:

$$y=G(x)=F(\mathrm{Gain}L_n \times x)$$

(2) over a range $Li_n < x \le Hi_n$:

$$y=G(x)=F((\alpha_n \times \mathrm{Gain}H_n+(1-\alpha_n)\times \mathrm{Gain}L_n)\times x)$$

(3) over a range $Hi_n < x$:

(A) in a case of $\mathrm{Gain}H_n \le 1$:

$$y=G(x)=F(\mathrm{Gain}H_n \times x)$$

(B) in a case of $1 < \mathrm{Gain}H_n$:

(B-1) if F(MAXi)=MAXo, then:

(if the LUT extension unit is not set, then:)

$$y=G(x)=F(a1_n \times x+b1_n)$$

(B-2) if F(MAXi)<MAXo, then:

(if the LUT extension unit is set, then:)

(i) when $\mathrm{Gain}H_n \le Q/\mathrm{MAX}i$:

(i-1) over a range of x where $0 \le \mathrm{Gain}H_n \times x \le \mathrm{MAX}i$:

$$y=G(x)=F(\mathrm{Gain}H_n \times x)$$

(i-2) over a range of x where $\mathrm{MAX}i < \mathrm{Gain}H_n \times x \le Q$:

$$y=G(x)=H(\mathrm{Gain}H_n \times x)$$

(ii) when $Q/\mathrm{MAX}i < \mathrm{Gain}H_n$:

(ii-1) over a range of x where $0 < c_n \times x+d_n \le \mathrm{MAX}i$:

$$y=G(x)=F(c_n \times x+d_n)$$

(ii-2) over a range of x where $\mathrm{MAX}i < c_n \times x+d_n \le Q$:

$$y=G(x)=H(c_n \times x+d_n)$$

(where $\mathrm{Gain}_{ref}$: initial value of a gain (adjustment value) applied to input values of the image data (the reference adjustment value)

$Li_{ref}$: input value of image data of a first adjustment image $Hi_{ref}$: input value of image data of a second adjustment image $(Li_{ref} < Hi_{ref})$ GainL: value of a gain applied to $Li_{ref}$ when a color balance of the first adjustment image becomes a specified color balance (conforming adjustment value)

GainH: value of a gain applied to $Hi_{ref}$ when a color balance of the second adjustment image becomes a specified color balance (conforming adjustment value)

$\mathrm{Gain}L_n=\mathrm{Gain}L/\mathrm{Gain}_{ref}$: normalized value of GainL $\mathrm{Gain}H_n=\mathrm{Gain}H/\mathrm{Gain}_{ref}$: normalized value of GainH $Li_n=Li_{ref} \times \mathrm{Gain}_{ref}$: normalized value of $Li_{ref}$ $Hi_n=Hi_{ref} \times \mathrm{Gain}_{ref}$: normalized value of $Hi_{ref}$ $\alpha_n=(x-Li_n)/(Hi_n-Li_n)$: interpolation coefficient $a1_n=(\mathrm{MAX}o-Ho_n)/(\mathrm{MAX}i-Hi_n)$ $b1_n=Ho_n-Hi_n \times (\mathrm{MAX}o-Ho_n)/(\mathrm{MAX}i-Hi_n)$ $c_n=(Q-Ho_n)/(\mathrm{MAX}i-Hi_n)$ $d_n=Ho_n-Hi_n \times (Q-Ho_n)/(\mathrm{MAX}i-Hi_n)$ $Ho_n=Hi_n \times \mathrm{Gain}H_n$ MAXi: maximum value that the LUT input value x can take in F(x) and G(x)

MAXo: maximum value that F(x) and G(x) can take

Q: maximum value that the extension unit input value x can take in H(x)).

9. The image display device according to claim 7, wherein the input value adjustment unit, the conforming adjustment value acquisition unit, the conforming adjustment value normalization unit, the LUT extension setting unit, and the LUT calculation unit are included in and controlled by the microcomputer.

10. A LUT adjustment method implemented by an image processor and a microcomputer, the method comprising:

an adjustment image display step in which an adjustment image is displayed on a color display after applying a gain or offset to input values of image data of the adjustment image and, based on LUT correction data, correcting the input values of image data of the adjustment image to which the gain or offset has been applied;

an adjustment value adjusting step in which the adjustment values that are values of the gain or offset applied to the input values of the image data of the adjustment image are adjusted such that a color balance of the adjustment image displayed in the adjustment image display step becomes a specified color balance;

a conforming adjustment value determination step in which the adjustment values that have been adjusted in the adjustment value adjusting step and that are the values of the gain or offset applied to the input values of the image data of the adjustment image when the color balance of the adjustment image becomes a specified color balance are determined as the conforming adjustment values;

a conforming adjustment value normalization step in which the conforming adjustment values determined in the conforming adjustment value determination step are normalized;

an adjustment-use input value normalization step in which the input values of the image data of the adjustment image are normalized;

a LUT extension unit setting step in which a LUT extension unit is set, with the LUT extension unit being a table indicating a relationship between extension unit input values which are values greater than a maximum value that a LUT input value of the LUT can take and extension unit output values which are corrected values of the extension unit input values; and a LUT calculation step in which the LUT correction data is calculated based on the conforming adjustment values normalized in the conforming adjustment value normalization step, the input values of the image data of the adjustment image normalized in the adjustment-use input value normalization step, the LUT correction data, and the correction data of the LUT extension unit that has been set in the LUT extension unit setting step; wherein if the LUT output value corresponding to the maximum value that the LUT input value of the LUT can take does not reach the maximum value that the LUT output value of the LUT can take, and also the conforming adjustment value determined in the conforming adjustment value determination step is greater than a reference adjustment value which is an initial value of the adjustment value applied to the input values of the image data of the adjustment image, then the LUT extension unit is set in the LUT extension unit setting step.

11. The LUT adjustment method according to claim 10, wherein the adjustment image display step, the adjustment value adjusting step, the conforming adjustment value determination step, the conforming adjustment value normalization step, the adjustment-use input value normalization step, the LUT extension unit setting step, and the LUT calculation step are performed by the microcomputer.

12. A display device comprising:

a lookup table which transforms an intensity level of an input signal; and a display which displays images based on the lookup table; wherein the lookup table includes a first range that is equal to or lower than a first intensity level, a second range that is higher than the first intensity level and lower than a second intensity level, a third range that is equal to or higher than the second intensity level, and first correction data that is set in the lookup table and calculated based on:

a first gain value and the lookup table over the first range;

the first gain value, a second gain value, and the lookup table over the second range; and the second gain value and the lookup table over the third range.

13. The display device of claim 12, further comprising a lookup table extension unit implemented in a microcomputer, wherein:

the lookup table includes second correction data that is set in advance, and the lookup table extension unit is set if an output value corresponding to a maximum value that the input value of the lookup table having the second correction data set therein can take is smaller than a specified output value, and also if the second gain value is greater than a specified gain value and which corresponds to an input value that is greater than a maximum value that the input value of the lookup table having the second correction data set therein can take.

14. The display device according to claim 13, wherein taking input values of the lookup table having the second correction data set therein, input values of the lookup table having the first correction data set therein, and input values of the lookup table extension unit to be x, output values of the lookup table having the second correction data set therein to be y=F(x), output values of the lookup table having the first correction data set therein to be y=G(x), and output values of the lookup table extension unit to be y=H(x), the display device calculates output values of the lookup table having the first correction data set therein y=G(x) as follows:

in a case of 1<GainH≤Q/MAXi and F(MAXi)<MAXo, y=G(x)=F(GainH×x) over a range of x where 0≤GainH×x≤MAXi (where $Li_{ref}$: the first intensity level, an input value of image data of a first adjustment image $Hi_{ref}$: the second intensity level, an input value of image data of a second adjustment image $$Li_{ref}<Hi_{ref}$$

GainH: the second gain value, a value of a gain applied to $Hi_{ref}$ when a color balance of the second adjustment image becomes a specified color balance (conforming adjustment value)

MAXi: maximum value that the input value x can take in F(x) and G(x)

MAXo: maximum value that F(x) and G(x) can take

Q: maximum value that the lookup table extension unit input value x can take in H(x)).

15. The display device according to claim 13, wherein taking input values of the lookup table having the second correction data set therein, input values of the lookup table having the first correction data set therein, and input values of the lookup table extension unit to be x, output values of the lookup table having the second correction data set therein to be y=F(x), output values of the lookup table having the first correction data set therein to be y=G(x), and output values of the lookup table extension unit to be y=H(x), the display device calculates output values of the lookup table having the first correction data set therein y=G(x) as follows:

in a case of 1<GainH≤Q/MAXi and F(MAXi)<MAXo, $$y=G(x)=H(\mathrm{Gain}H\times x) \text{ over a range of } x \text{ where } \mathrm{MAX}i<\mathrm{Gain}H\times x\leq Q$$

(where $Li_{ref}$: the first intensity level, an input value of image data of a first adjustment image $Hi_{ref}$: the second intensity level, an input value of image data of a second adjustment image $(Li_{ref}<Hi_{ref})$ GainH: the second gain value, a value of a gain applied to Hiref when a color balance of the second adjustment image becomes a specified color balance (conforming adjustment value)

MAXi: maximum value that the input value x can take in F(x) and G(x)

MAXo: maximum value that F(x) and G(x) can take

Q: maximum value that the lookup table extension unit input value x can take in H(x)).

16. The display device according to claim 13, wherein taking input values of the lookup table having the second correction data set therein, input values of the lookup table having the first correction data set therein, and input values of the lookup table extension unit to be x, output values of the lookup table having the second correction data set therein to be y=F(x), output values of the lookup table having the first correction data set therein to be y=G(x), and output values of the lookup table extension unit to be y=H(x), the display device calculates output values of the lookup table having the first correction data set therein y=G(x) as follows:

in a case of 1<GainH and Q/MAXi<GainH:

$y=G(x)=F(c\times x+d)$ over a range of $x$ where $0<c\times x+d\leq MAXi$:

(where $Li_{ref}$: the first intensity level, an input value of image data of a first adjustment image $Hi_{ref}$: the second intensity level, an input value of image data of a second adjustment image $Li_{ref}<Hi_{ref}$ GainH: the second gain value, a value of a gain applied to $Hi_{ref}$ when a color balance of the second adjustment image becomes a specified color balance (conforming adjustment value)

MAXi: maximum value that the input value x can take in F(x) and G(x)

MAXo: maximum value that F(x) and G(x) can take

Q: maximum value that the lookup table extension unit input value x can take in H(x)).

17. The display device according to claim 13, wherein taking input values of the lookup table having the second correction data set therein, input values of the lookup table having the first correction data set therein, and input values of the lookup table extension unit to be x, output values of the lookup table having the second correction data set therein to be y=F(x), output values of the lookup table having the first correction data set therein to be y=G(x), and output values of the lookup table extension unit to be y=H(x), the display device calculates output values of the lookup table having the first correction data set therein y=G(x) as follows:

in a case of 1<GainH and Q/MAXi<GainH:

$y=G(x)=H(c\times x+d)$ over a range of $x$ where $MAXi<c\times x+d\leq Q$ (where $Li_{ref}$: the first intensity level, an input value of image data of a first adjustment image $Hi_{ref}$: the second intensity level, an input value of image data of a second adjustment image $Li_{ref}<Hi_{ref}$ GainH: the second gain value, a value of a gain applied to $Hi_{ref}$ when a color balance of the second adjustment image becomes a specified color balance (conforming adjustment value)

MAXi: maximum value that the input value x can take in F(x) and G(x)

MAXo: maximum value that F(x) and G(x) can take

Q: maximum value that the lookup table extension unit input value x can take in H(x)).

18. The display device according to claim 12, wherein taking input values of the lookup table having the second correction data set therein and input values of the lookup table having the first correction data set therein to be x, output values of the lookup table having the second correction data set therein to be y=F(x), and output values of the lookup table having the first correction data set therein to be y=G(x), the display device calculates output values of the lookup table having the first correction data set therein y=G(x) as follows:

in a case of GainH≤1:

$y=G(x)=F(\text{Gain}H\times x)$ (where $Li_{ref}$: the first intensity level, an input value of image data of a first adjustment image $Hi_{ref}$: the second intensity level, an input value of image data of a second adjustment image $Li_{ref}<Hi_{ref}$ GainH: the second gain value, a value of a gain applied to $Hi_{ref}$ when a color balance of the second adjustment image becomes a specified color balance (conforming adjustment value)).

19. The display device according to claim 12, wherein taking input values of the lookup table having the second correction data set therein and input values of the lookup table having the first correction data set therein to be x, output values of the lookup table having the second correction data set therein to be y=F(x), and output values of the lookup table having the first correction data set therein to be y=G(x), the display device calculates output values of the lookup table having the first correction data set therein y=G(x) as follows:

in a case of 1<GainH and F(MAXi)=MAXo $y=G(x)=(a1\times x+b1)$ (where $Li_{ref}$: the first intensity level, an input value of image data of a first adjustment image $Hi_{ref}$: the second intensity level, an input value of image data of a second adjustment image $Li_{ref}<Hi_{ref}$ GainH: the second gain value, a value of a gain applied to $Hi_{ref}$ when a color balance of the second adjustment image becomes a specified color balance (conforming adjustment value)

MAXi: maximum value that the input value x can take in F(x) and G(x)

MAXo: maximum value that F(x) and G(x) can take $a1=(MAXo-Ho_{ref})/(MAXi-Hi_{ref})$ $b1=Ho_{ref}-Hi_{ref}\times(MAXo-Ho_{ref})/(MAXi-Hi_{ref})$ $Ho_{ref}=Hi_{ref}\times\text{Gain}H$ Q: maximum value that the extension unit input value x can take in H(x)).

20. The display device according to claim 12, wherein, if the first gain value and the second gain value are different, the first correction data is calculated by multiplying a value that is calculated based on the first gain value, the second gain value, and the lookup table by an interpolation coefficient over the second range, and the interpolation coefficient changes in accordance with the intensity level of the input value.

* * * * *